US010960902B2

(12) United States Patent
Donnelly

(10) Patent No.: US 10,960,902 B2
(45) Date of Patent: Mar. 30, 2021

(54) SYSTEMS AND METHODS FOR BALANCING A SINGLE TRUCK INDUSTRIAL LOCOMOTIVE

(71) Applicant: Tractive Power Coproration, North Vancouver (CA)

(72) Inventor: Frank Wegner Donnelly, North Vancouver (CA)

(73) Assignee: Tractive Power Corporation, North Vancouver (CA)

( * ) Notice: Subject to any disclaimer, the term of this patent is extended or adjusted under 35 U.S.C. 154(b) by 352 days.

(21) Appl. No.: 15/860,960

(22) Filed: Jan. 3, 2018

(65) Prior Publication Data

US 2018/0257679 A1 Sep. 13, 2018

Related U.S. Application Data

(60) Provisional application No. 62/441,748, filed on Jan. 3, 2017.

(51) Int. Cl.

| | |
|---|---|
| ***B61F 5/30*** | (2006.01) |
| ***B61F 1/14*** | (2006.01) |
| ***B61F 5/52*** | (2006.01) |
| ***B61F 3/10*** | (2006.01) |
| ***B61F 5/06*** | (2006.01) |
| ***B61F 5/16*** | (2006.01) |

(52) U.S. Cl.

CPC ..... *B61F 5/301* (2013.01); *B61F 1/14* (2013.01); *B61F 3/10* (2013.01); *B61F 5/06* (2013.01); *B61F 5/16* (2013.01); *B61F 5/52* (2013.01)

(58) Field of Classification Search

CPC ..... B61F 1/14; B61F 3/10; B61F 5/04; B61F 5/06; B61F 5/16; B61F 5/301; B61F 5/52

See application file for complete search history.

(56) References Cited

U.S. PATENT DOCUMENTS

| | | | |
|---|---|---|---|
| 1,568,197 | A | 1/1926 | Stumpf |
| 1,754,995 | A | 4/1930 | Galligan |
| 3,288,083 | A | 11/1966 | Jones |
| 3,529,552 | A | 9/1970 | Bolte et al. |
| 3,693,553 | A | 9/1972 | Lich |
| 4,040,360 | A | 8/1977 | Jackson |

(Continued)

OTHER PUBLICATIONS

Eudaly et al., "Santa Fe Rails," vol. 1, White River Productions, 1996, Kansas City, MO, ISBN 0-89745-987-3, pp. 1-144.

(Continued)

*Primary Examiner* — Ryan A Reis

(74) *Attorney, Agent, or Firm* — Sheridan Ross P.C.

(57) ABSTRACT

A bolster system and method of balancing a locomotive on a bolster system is provided. The bolster system is configured such that weld seams interconnect the locomotive to the bolster, and the weld seams are oriented such that when the truck or locomotive impacts another device on the rail track, the weld seams experience a shearing force along the lengths of the weld seams. In addition, prior to welding, scales such as hydraulic jacks with gauges may be used to center and balance a locomotive on a bolster. In one embodiment, four hydraulic jacks elevate the truck, bolster, and locomotive, and the locomotive is repositioned on the bolster until the hydraulic jacks have substantially similar measures.

21 Claims, 18 Drawing Sheets

(56) References Cited

U.S. PATENT DOCUMENTS

| | | | | |
|---|---|---|---|---|
| 4,040,361 | A | 8/1977 | Jackson | |
| 4,043,272 | A | 8/1977 | Jones et al. | |
| 4,088,080 | A | 5/1978 | Jackson | |
| 4,311,098 | A | 1/1982 | Irwin | |
| 4,440,094 | A | 4/1984 | Levy | |
| 4,485,743 | A | 12/1984 | Roush et al. | |
| 4,793,047 | A * | 12/1988 | Curtis | B61F 5/36 105/199.3 |
| 5,099,767 | A | 3/1992 | Gunter et al. | |
| 5,174,218 | A * | 12/1992 | List | B61D 3/10 105/167 |
| 5,613,444 | A | 3/1997 | Ahmadian et al. | |
| 5,746,135 | A | 5/1998 | Ahmadian et al. | |
| 6,006,674 | A | 12/1999 | Ahmadian et al. | |
| 6,305,561 | B1 * | 10/2001 | Kaufhold | B61F 5/16 213/51 |
| 6,401,627 | B1 | 6/2002 | Fehrenbach et al. | |
| 6,408,766 | B1 | 6/2002 | McLaughlin et al. | |
| 8,313,111 | B2 | 11/2012 | Ahuja et al. | |
| 8,561,545 | B2 | 10/2013 | Donnelly | |
| 8,807,047 | B2 | 8/2014 | Donnelly | |
| 2011/0203480 | A1 * | 8/2011 | Donnelly | B61C 7/04 105/35 |
| 2014/0116287 | A1 * | 5/2014 | Goding | B61F 3/04 105/96 |
| 2016/0001794 | A1 * | 1/2016 | Gibney | B61F 1/14 105/418 |

OTHER PUBLICATIONS

Kratville, William, ed., "The Car and Locomotive Encyclopedia of American Practices," Sixth Edition, 1997, Simmons-Boardman Books, p. 537.

Railcar Movers Industry Online website, Apr. 10-11, 2009, retrieved from www.railcarmover.com, 10 pages.

Reed, "Critters, Dinkys & Centercabs: The identification guide for small American gas and Diesel locomotives," 2000, ISBN 0-9647221-2-7, pp. 1-192.

Reed, ed., "Comprehensive Guide to Industrial Locomotives," Third Edition, 2002, ISBN 0-9647221-3-5, pp. 1-107.

Thomson "Image of Milwaukee Road CMStP&P Electric Shop Switcher X3800," May 2007, retrieved from www.flickriver.com/photos/hunter1828/502911146/, 4 pages.

SDP45 "Image of Milwaukee Road Deer lodge Shop goat X3800," Jul. 2008, retrieved from www.flickr.com/photos/sdp45/2720859973, 2 pages.

Official Action for Canadian Patent Application No. 2729512, dated Feb. 20, 2017, 6 pages.

Official Action for U.S. Appl. No. 13/016,553, dated Jan. 25, 2013, 7 pages.

Notice of Allowance for U.S. Appl. No. 13/016,553, dated Jun. 11, 2013, 11 pages.

Notice of Allowance for U.S. Appl. No. 14/028,184 dated Apr. 11, 2014, 9 pages.

* cited by examiner

SYSTEMS AND METHODS FOR BALANCING A SINGLE TRUCK INDUSTRIAL LOCOMOTIVE

CROSS REFERENCE TO RELATED APPLICATION

This application claims the benefit of U.S. Provisional Patent Application No. 62/441,748 entitled "Balancing a Single Truck Industrial Locomotive" filed Jan. 3, 2017, the entire disclosure of which is incorporated by reference herein.

FIELD OF INVENTION

This invention relates to multi-axle, self-propelled industrial locomotive and it relates more particularly to a method of adjusting the distribution of the total static weight of a locomotive on a single truck so that a predetermined distribution of axle loads is obtained.

BACKGROUND OF THE INVENTION

Small industrial locomotives are typically used to move one to several rail cars in and around a factory, a mine, a small rail yard, a shipping hub and the like. These are typically small locomotives with two or more axles attached directly to the locomotive frame or by means of swiveling truck assemblies that are attached to the locomotive car body. An example of a small industrial locomotive of this type is shown in FIG. 1.

For larger industrial applications, used or new switcher locomotives or used line-haul locomotives are often employed. An example of a switcher locomotive (not intended for moving trains over long distances but rather for assembling trains) is shown in FIG. 2. An example of a line-haul locomotive (primarily engaged in line-haul railroad passenger and freight operations from one city to another) is shown in FIG. 3.

Railcar movers are another alternative for moving rail cars about a rail yard. These are road-rail vehicles capable of traveling on both roads and rail tracks. They are fitted with couplers for moving small numbers of railroad cars around in a rail siding or small yard. Railcar movers are typically less expensive than switcher locomotives and more productive than manual moving of cars. They are more versatile since they can travel on road wheels to the cars they need to move, instead of requiring clear track.

There are basically two types of mobile railcar movers available. The first type developed in the late forties utilizes steel driven rail wheels for motive effort on rail track. Off road movement is developed by engaging rubber tires with drive sprocket extensions on the rail wheels. The second type developed in the early seventies generates its motive effort on the rail through rubber tires. Off road movement uses the same drive system and rubber tires.

The tasks of marshaling of railcars in a rail yard or spotting railcars in an industrial facility are usually done by switcher locomotives, industrial locomotives or railcar movers. The problem that has developed in relatively recent times is the shortage of suitable equipment to do switching and spotting functions. In the past, larger locomotives that became obsolete and surplus to the railroads for line-haul service could be reused in lighter duty industrial and switcher service. Nowadays, more often than not, this is no longer possible. Today because of their sheer size and power, currently available surplus line-haul locomotives are unsuitable for any service other than that for which they were originally designed.

U.S. Pat. No. 8,561,545 entitled "Industrial Locomotive Construction" discloses a robust industrial locomotive such as shown in FIG. 6, wherein a locomotive cab assembly is attached to a three axle truck assembly salvaged from a used line-haul locomotive. The locomotive shown in FIG. 6 comprises a main frame or platform, a superstructure and a three-axle truck assembly. The platform and superstructure are herein jointly referred to as the locomotive body. The locomotive body is typically mated to the truck assembly by a modified floating bolster, which will be described subsequently. U.S. Pat. No. 8,561,545 is incorporated herein by reference.

Surplus four-axle locomotives with two-axle trucks from line haul service are the type of locomotive that are sought after for switching and industrial applications and therefore have an intrinsic value greater than the larger six-axle locomotives with their pair of three-axle trucks. The present situation is that the majority of available surplus line-haul locomotives have been replaced by newer locomotives. The surplus line-haul locomotives are the six-axle type which cannot be economically used for the switching and industrial service and are often discarded as scrap.

Line haul locomotives comprising two truck assemblies must have the ability for the truck assemblies to rotate under the locomotive body in order to negotiate curves in the track. The ability to rotate is typically obtained by the use of a floating bolster assembly between the locomotive body and the truck assemblies.

In the single 3-axle truck design disclosed in U.S. Pat. No. 8,561,545, there is no need for rotation of the locomotive body to rotate relative to its single truck assembly. In U.S. Pat. No. 8,561,545, a modified floating bolster assembly is used to mate the locomotive body to the truck assembly. Modifying a floating bolster assembly is expensive and it is difficult to balance the locomotive body on the truck assembly such that the weight on one or more axle does not exceed a specified maximum axle load limit, while the weights on other axles might be below a specified minimum load limit. Also, modifying a floating bolster to mate the locomotive body to the truck assembly must be done in such a way as to be strong enough to take the repetitive forces associated with assembling cars to form a consist or to take the occasional large impact force from an operator mistake (for example impacting a loaded rail car at greater than 5 mph).

There is therefore a need for a simpler method of attaching a locomotive body to a single truck assembly that will permit balancing of the locomotive body on the truck assembly so as not to exceed a specified maximum axle load limit and so as to withstand the repetitive forces generated in assembling a consist or the occasional large impact force from an operator mistake.

A specific embodiment of the present invention is a bolster system for a locomotive, comprising a truck configured to travel along a rail, the truck having an axle with a rotation axis and the truck having at least one suspension device with a suspension axis, wherein the suspension axis is substantially perpendicular to the rotation axis; a bolster interconnected to the at least one suspension device such that the bolster moves relative to the truck along the suspension axis; a first underframe plate and a second underframe plate of the bolster, wherein the underframe plates define an upper surface of the bolster; and a locomotive body interconnected to the bolster, wherein a first weld seam interconnects the locomotive body to the first underframe plate, and a second weld seam interconnects the locomotive body to the second underframe plate, and wherein the weld seams are oriented substantially perpendicular to the rotation axis of the axle of the truck and substantially perpendicular to the suspension axis of the at least one suspension device.

In various embodiments, the first underframe plate has a longitudinal dimension that is substantially perpendicular to the rotation axis of the axle of the truck and substantially perpendicular to the suspension axis of the at least one suspension device. In some embodiments, the first welded seam has a longitudinal dimension which is at least 60% as long as the longitudinal dimension of the first underframe plate. In various embodiments, the at least one suspension device is a coil spring. In some embodiments, the truck comprises three axles. In some embodiments, the weld seams are continuous along a longitudinal dimension.

Another particular embodiment of the present invention is a method for positioning a locomotive on a bolster, comprising (i) providing a truck having an axle with a rotation axis and having at least one suspension device with a suspension axis, wherein the suspension axis is substantially perpendicular to the rotation axis; (ii) positioning a bolster on the at least one suspension device of the truck such that the bolster moves relative to the truck along the suspension axis; (iii) positioning a locomotive body on the bolster; (iv) providing four scales underneath four points of the truck, wherein each scale is configured to determine a weight measurement; (v) determining, by each scale, a weight measurement; (vi) repositioning the locomotive body on the bolster such that each scale determines a weight measurement with a predetermined range; and (vii) welding a first seam and a second seam between the locomotive body and the bolster, wherein the seams are oriented substantially perpendicular to the rotation axis of the axle of the truck and to the suspension axis of the at least one suspension device.

In some embodiments, the method further comprises (viii) providing a first underframe plate and a second underframe plate of the bolster, wherein the underframe plates define an upper surface of the bolster, the locomotive is positioned on the underframe plates, and the seams are located on the underframe plates. In various embodiments, the four scales are hydraulic jacks with pressure gauges. In some embodiments, the four points are equidistant from a center point of the truck.

In various embodiments, the locomotive body is repositioned such that each scale determines substantially the same weight measurement. In some embodiments, the seams have a longitudinal dimension which is at least 60% as long as a longitudinal dimension of the bolster. In various embodiments, the seams have a continuous longitudinal dimension. In some embodiments, the method further comprises (ix) filling the locomotive with a predetermined amount of fuel prior to the determining step.

Yet another particular embodiment of the present invention is a method for positioning a locomotive on a bolster, comprising (x) providing a truck having an axle with a rotation axis and having at least one suspension device with a suspension axis, wherein the suspension axis is substantially perpendicular to the rotation axis; (xi) positioning a bolster on the at least one suspension device of the truck such that the bolster moves relative to the truck along the suspension axis; (xii) positioning a locomotive body on the bolster; (xiii) providing a scale underneath a first point of the truck, wherein the scale is configured to determine a weight measurement; (xiv) determining, by the scale, a first weight measurement underneath the first point of the truck; (xv) repositioning the scale underneath a second point, a third point, and a fourth point of the truck to determine a second weight measurement, a third measurement, and a fourth measurement, respectively; (xvi) repositioning the locomotive body on the bolster such that the weight measurements are within a predetermined range; and (xvii) welding a first seam and a second seam between the locomotive body and the bolster, wherein the seams are oriented substantially perpendicular to the rotation axis of the axle of the truck and substantially perpendicular to the suspension axis of the at least one suspension device.

In some embodiments, the locomotive body is repositioned such that each scale determines substantially the same weight measurement. In various embodiments, the method further comprises (xviii) providing a first underframe plate and a second underframe plate of the bolster, wherein the underframe plates define an upper surface of the bolster, the locomotive is positioned on the underframe plates, and the seams are welded to the underframe plates. In some embodiments, the four scales are hydraulic jacks with pressure gauges. In various embodiments, determining each weight measurement comprises raising the truck by approximately 1/32 inch. In some embodiments, the seams have a longitudinal dimension which is at least 60% as long as a longitudinal dimension of the bolster.

SUMMARY OF THE INVENTION

These and other needs are addressed by the present disclosure. The various embodiments and configurations of the present disclosure are directed generally to providing an improved method of manufacturing industrial locomotives such that the locomotive body is properly balanced on its truck assembly to achieve a predetermined axle load distribution which is not appreciably changed if the truck assembly of the locomotive were interchanged with another comparable truck assembly.

FIG. 6 shows a prior art industrial locomotive which uses a modified floating bolster to attach the locomotive body to a 3-axle truck assembly such as used on the line-haul locomotive shown in FIG. 3.

The present disclosure describes a frame designed to replace the modified floating bolster described in U.S. Pat. No. 8,561,545. This frame is designed to be welded onto a locomotive body with enough weld to easily survive repetitive forces generated in assembling a consist or the occasional large impact force from an operator mistake. The locomotive body along with the welded frame can then be mated to the truck assembly in the same way a well-known floating bolster assembly mates to a three axle truck assembly.

The steel frame that is part of the present disclosure is shown in FIG. 10. The primary advantage of the bolster configuration of FIG. 10 compared to that described in FIG. 6 is that the locomotive body can be welded onto the two long bolster underframe contact plates with long continuous welds. On impact with other rail cars, these welds are subject to primarily shear loads which is a strength advantage of welded joints. Thus both the length and orientation of the weldments are a substantial improvement over the design of attachment of the locomotive body to the bolster described in FIG. 6.

The locomotive body and frame must be weighed and balanced on the truck assembly before final assembly and outfitting.

Before the locomotive body is balanced, the locomotive may be loaded with the supplies normally used in operation. For instance, the fuel tank is filled with diesel fuel oil, water is supplied to the cooling water tank, pipes and heat exchangers, lubricating oil is supplied to the engine lube oil system, and a locomotive battery is put in the battery box.

To accomplish this, hydraulic jacks may be positioned under each of the two locations on the first and third axle of the truck assembly. The frame is then set on the four rubber bolster mounts of the truck assembly. The locomotive body is then set on the frame at the approximate position that it will be welded to the frame.

The hydraulic jacks are then energized to lift the locomotive while pressure gages on each hydraulic jack record the hydraulic pressure. Once the locomotive is raised off the rails, the pressure at all four jacks is noted. The locomotive body is then moved longitudinally along the underframe contact plate and laterally across the underframe contact plate until the readings of the four hydraulic pressure gages become equal to each other within a predetermined amount.

Once the four hydraulic pressure gages become equal to each other within a predetermined amount, the locomotive body is deemed to be balanced on the truck assembly and the positions of the locomotive body on the underframe contact plates are marked. The weight of the locomotive is then determined by the hydraulic pressures on the four jacks converted to mass by the known lifting area of the jacks.

The locomotive body is moved laterally and longitudinally along the two long bolster underframe contact plates until balance is achieved. Balance is achieved when the load on each of the four jacks are equal to within a predetermined specification (typically within 5% of each other). When proper balance is achieved, then the position of the locomotive body is marked on the two long bolster underframe contact plates. The locomotive body and bolster frame are removed from the truck assembly and the locomotive body is then welded to the two long bolster underframe contact plates to form a rigid unit.

In the case of the industrial locomotive of the present disclosure, the weight of supplies normally used in operation (fuel, lubrication oil etcetera) is on the order of 1 to 2 tons. The fully loaded industrial locomotive of the present disclosure is estimated to weigh about 100 tons so the weight of supplies normally used in operation is only about 1% to 2% of the total locomotive weight and weight of supplies normally used in operation may be neglected.

Therefore, an alternative balancing and weighing procedure is to use only one hydraulic jack and lift each axle in turn by lifting on the journal housing until the wheel nearest the jack is lifted off the rail by approximately about 1/32 of an inch. When this occurs, the weight on the axle on the side being lifted is very close to the weight that this axle experiences (known to be close within 5%). The weight is determined by the hydraulic pressure on the jack converted to mass by the known lifting area of the jack.

The above frame design and balancing/weighing procedures can also be applied to industrial locomotives mounted on a two axle truck assembly.

The following definitions are used herein:

Adhesion is a measure of the resistance of friction to slippage between two parallel planes. In the case of a locomotive rail wheel, the parallel plane is the point on the steel rail wheel where the rail wheel contacts the steel rail. The maximum force or pull that a locomotive can generate in order to pull a train is limited by the weight of the locomotive and the amount of adhesion that it can maintain without wheel slippage.

A bolster is a structural component connecting a locomotive truck assembly to the frame of a locomotive so as to allow vertical, transverse and/or longitudinal movements of the truck assembly with respect to the locomotive car frame. For a locomotive with more than one truck assembly, the bolster can allow the locomotive body to rotate on the bolster assembly in order to negotiate curves and grades.

A burden car is a single car that carries cargo and provides its own propulsion.

A driver (or driven) axle is a rotating axle that transmits power from the propulsion system to the rails. A driver may refer to an axle or a wheel.

Dynamic braking is typically implemented when the electric propulsion motors are switched to generator mode during braking to augment the braking force. The electrical energy generated is typically dissipated in a resistance grid system. Dynamic braking can also be accomplished using pneumatics or hydraulics.

An energy storage system refers to any apparatus that acquires, stores and distributes mechanical or electrical energy which is produced from another energy source such as a prime energy source, a regenerative braking system, a third rail and an overhead wire and any external source of electrical energy. Examples are a battery pack, a bank of capacitors, a compressed air storage system and a bank of flywheels.

An engine refers to any device that uses energy to develop mechanical power, such as motion in some other machine. Examples are diesel engines, gas turbine engines, microturbines, Stirling engines and spark ignition engines.

A floating bolster means a transverse floating beam member of a truck suspension system supporting the weight of the locomotive body. Such a bolster is not rigidly connected to either the locomotive body or the truck assembly on which it sits.

A hump is a raised section in a rail sorting yard that allows operators to use gravity to move freight railcars into the proper position within the yard when making up trains of cars.

An idler axle is a rotating axle that is not powered. An idler may refer to an axle or a wheel.

Kicking mean shoving a rail car a short distance and uncoupling it in motion, allowing it to roll free under gravity and/or its own inertia onto a track. Kicking is commonly practiced in bowl or hump yards to make up or break down trains or classify large numbers of cars in an expedient fashion. Kicking differs from a flying switch in that the locomotive is pushing the car rather than pulling it when the cut is made.

A line-haul locomotive is a locomotive primarily engaged in line-haul railroad passenger and freight operations from one city to another as differentiated from local switching service. A locomotive used for the movement of trains between terminals and stations on the main or branch lines of the road, exclusive of switching movements.

A prime power source refers to any device that uses energy to develop mechanical or electrical power, such as motion in some other machine. Examples are diesel engines, gas turbine engines, microturbines, Stirling engines, spark ignition engines or fuel cells.

Spotting means moving a rail car or cars into their desired positions using a locomotive to get a train loaded or unloaded at a facility.

A switcher, switch engine, or yard goat, is a small railroad locomotive intended not for moving trains over long distances but rather for assembling trains ready for a road locomotive (also known as a line haul locomotive) to take over, disassembling a train that has been brought in, and generally moving railroad cars around—a process usually known as switching A traction motor is a motor used primarily for propulsion such as commonly used in a locomotive. Examples are an AC or DC induction motor, a permanent magnet motor and a switched reluctance motor.

Tractive effort is the force applied by the driving wheels parallel to the track. Tractive effort is a synonym of tractive force, typically used in railway engineering terminology when describing the pulling power of a locomotive. The tractive effort provided by a particular locomotive varies depending on speed and track conditions, and is influenced by a number of other factors.

A truck assembly is an undercarriage assembly of a locomotive incorporating the train wheels, suspension, brakes and the traction motors. The truck assembly supports the weight of the locomotive, provides the propulsion, suspension and braking. (Outside of North America, a truck assembly is known as a bogie assembly.) Traction motors, typically one on each driving axle, provide propulsion to the wheels. The weight of the locomotive typically rests on a bolster which allows the trucks to pivot so the locomotive can negotiate a curve. Below the bolster, there is typically a leaf spring that rests on a platform suspended by metal links. These links allow the locomotive to swing from side to side. The weight of the locomotive rests on the leaf springs, which compress when the locomotive passes over a bump. This isolates the body of the locomotive from the bump. The links allow the trucks to move from side to side with fluctuations in the track. The system also keeps the amount of weight on each rail relatively equal, reducing wear on the tracks and wheels. Braking is provided by various mechanisms on the trucks. A locomotive typically comprises a body supported near its opposite ends on a pair of truck assemblies (sometimes called bogies). The body includes a main frame or platform, a superstructure, and various systems, subsystems, apparatus and components that are located in the superstructure or attached to the platform. Each truck assembly includes a frame and two or more axle-wheel sets supporting the frame by means of journals near opposite ends of each axle. In addition, a truck assembly typically includes a floating bolster or center plate between the truck frame and a cooperating load-transmitting pin on the underside of the platform. Each locomotive truck may also include two or more electric traction motors, one per axle-wheel set. Each motor is hung on an axle inboard with respect to the associated wheels, and its rotor is mechanically coupled via torque amplifying gearing to that axle. A three-axle truck can be of either symmetrical or asymmetrical construction. If the center axle were located midway between the other two, the truck would be symmetric; if not, it would be asymmetric.

A truck side bearing is a plate or block, roller or elastic unit fastened to the top surface of a truck bolster on both sides of the center plate and functioning in conjunction with a body side bearing to control the relative movement between the truck assembly and the locomotive car body when there are variations in the track.

The phrases at least one, one or more, and and/or are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

BRIEF DESCRIPTION OF THE DRAWINGS

The present disclosure may take form in various components and arrangements of components, and in various steps and arrangements of steps. The drawings are only for purposes of illustrating the preferred embodiments and are not to be construed as limiting the disclosure. In the drawings, like reference numerals may refer to like or analogous components throughout the several views.

DETAILED DESCRIPTION OF THE DRAWINGS

In this disclosure, an apparatus and a method are described that relates to a heavy, multi-axle, self-propelled industrial locomotive and it relates more particularly to a method of adjusting the distribution of the total static weight of a locomotive so that a predetermined distribution of axle loads is obtained. The disclosure is applicable to a locomotive incorporating a single truck assembly. The truck assembly may be a two or three axle truck. In this disclosure, a three axle truck is used to illustrate the apparatus and a method.

Prior Art

Figure 1:
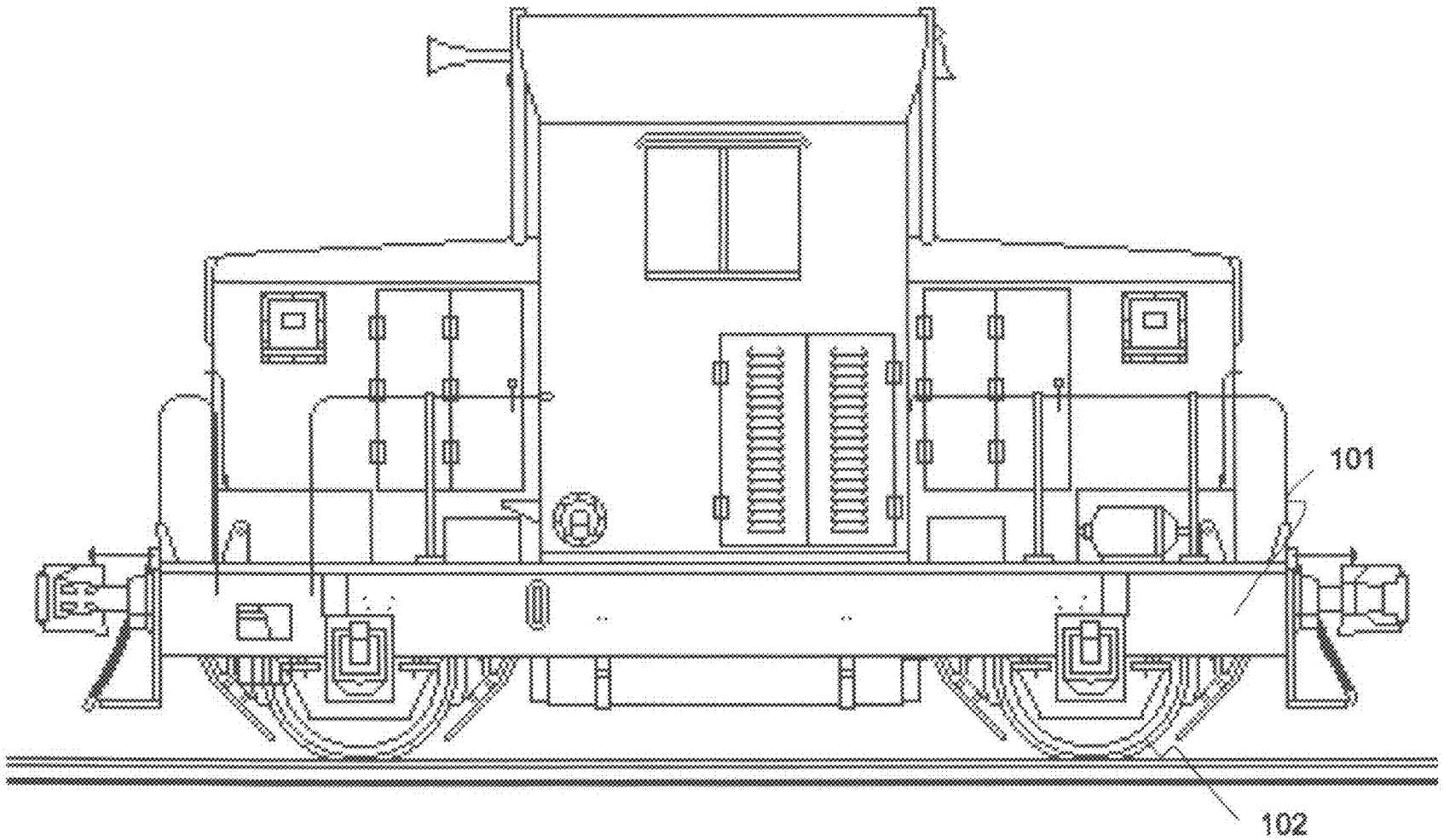
Figure 1 (Prior Art)
FIG. 1 is a schematic of a typical prior art small industrial locomotive without a truck assembly.

FIG. 1 shows a typical prior art small industrial locomotive without a separate truck assembly. The wheel and axle assemblies 102 are typically attached directly to the frame 101 of the locomotive body. Thus, there is no ability of the wheel and axle assemblies 102 to swivel when the locomotive negotiates a curve. There is also limited suspension to absorb shocks from bumps or deviations of the rails. Since these locomotives are usually operated at low speeds, the limited suspension system is not a major liability. Small industrial locomotives, not counting used switcher or line-haul locomotives, typically have two to four axles and a rated horsepower in the range of approximately 200 HP to about 600 HP.

Figure 2:
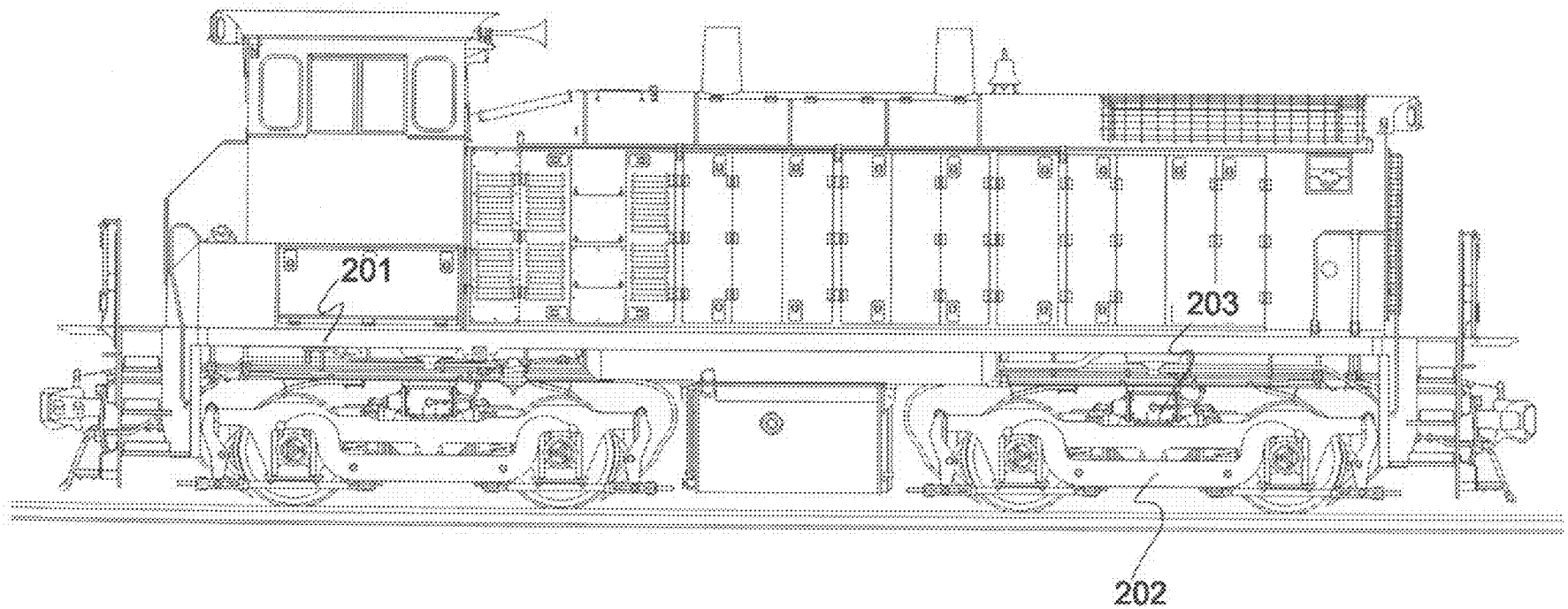
Figure 2 (Prior Art)
FIG. 2 shows a typical prior art switcher locomotive.

FIG. 2 shows a typical prior art switcher locomotive illustrating a pair of two-axle truck assemblies 202 attached to the locomotive body 201 by bolsters 203. The bolsters 203 allow the trucks to swivel as the locomotive negotiates a curve. The switcher typically has a traction motor on each axle. The switcher therefore can have a total of four traction motors mounted on four driving axles for applying maximum tractive effort. Switcher locomotives typically have a pair of two-axle trucks and a rated horsepower in the range of approximately 600 HP to about 1,500 HP.

Figure 3:
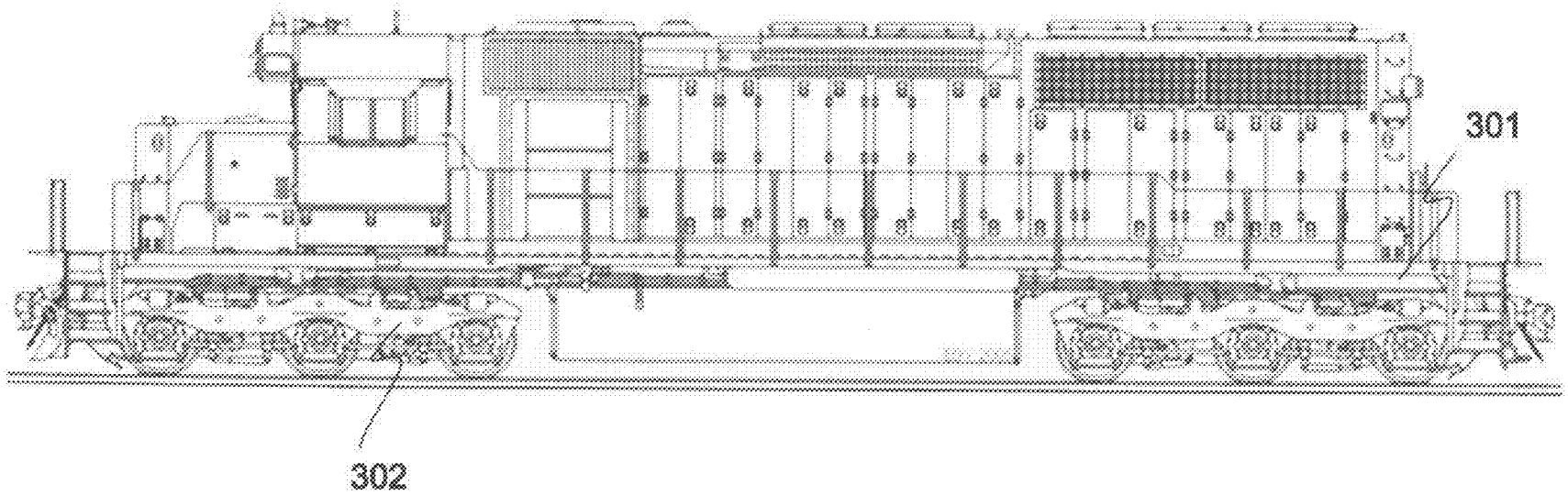
Figure 3 (Prior Art)
FIG. 3 shows a typical prior art line-haul locomotive.

FIG. 3 shows a typical prior art line-haul locomotive illustrating a pair of three-axle truck assemblies 302 attached to the locomotive body 301 by bolsters (not visible but similar to those shown in FIG. 2). The locomotive typically has a traction motor on each axle. The locomotive therefore can have a total of six traction motors mounted on six driving axles for applying maximum tractive effort. Line-haul locomotives typically have a pair of two-axle trucks or a pair of three-axle trucks and a rated horsepower in the range of approximately 1,500 HP to about 6,000 HP.

Figure 4:
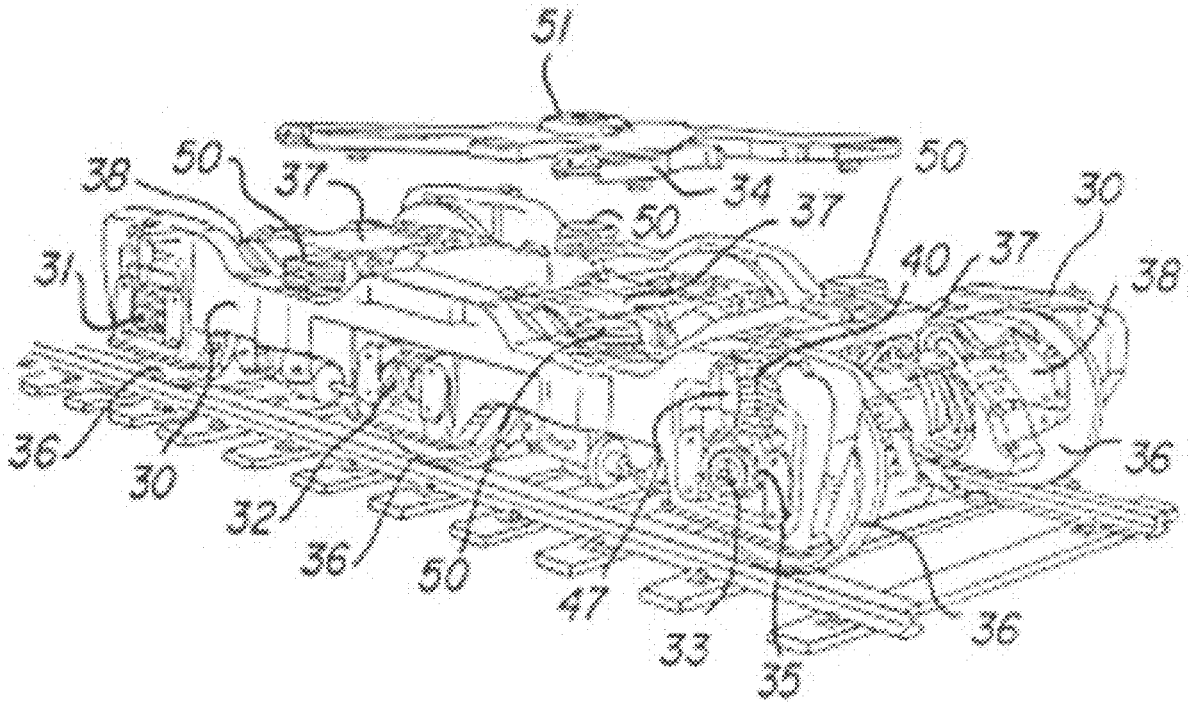
Figure 4 (Prior Art)
FIG. 4 shows a schematic of a prior art three axle truck assembly with a floating bolster such as used on line-haul locomotive of FIG. 3.

FIG. 4 shows a prior art truck assembly taken from U.S. Pat. No. 4,793,047 entitled "Method of Adjusting the Distribution of Locomotive Axle Loads". As is shown in FIG. 4 (the description of which is taken from that of FIG. 2 of U.S. Pat. No. 4,793,047), each truck assembly comprises a metal frame 30, three parallel axle-wheel sets 31, 32, and 33, and a floating bolster 34. Each axle-wheel set supports the frame by means of a pair of conventional journals located in housings 35 near opposite ends of the axle on the outboard sides of the associated wheels 36. Axle-hung electric traction motors 37 are disposed between the wheels of the respective axle-wheel sets, and the rotor of each motor is mechanically coupled to the associated axle-wheel set by gearing housed in a gear box 38. In a conventional manner, the traction motors associated with the front and middle axles 31 and 32 are located to the rear of these axles, respectively, whereas the traction motor associated with the rear axle 33 is located to the front thereof.

The primary suspension system of each truck comprises twelve dual, concentrically nesting, vertical helical springs (sometimes called coil springs) arranged in six sets of two each, with the springs in each set being disposed in compression between a spring seat on top of a separate one of the axle journal housings 35 and a cooperating pocket in a side channel of the frame 30. The outboard wall of one such pocket has been cut away in FIG. 4 to reveal a typical pair 40 of these nesting springs. A shock absorber or "snubber" 47 is connected in parallel with at least one set of axle springs on each side of the truck assembly.

The secondary suspension system of each truck comprises four rubber bolster mounts 50 which are respectively seated on pads located on top of the inter-axle sections of the two side channels of the truck frame 30. These bolster mounts support the bolster 34 at load points near the four corners thereof. FIG. 4 shows the bolster 34 detached from the rest of the truck assembly so as to expose the four bolster mounts 50. Each bolster mount comprises a unitary stack of curved rubber pads interleaved with correspondingly curved steel plates. The rubber pads are relatively soft horizontally and will deflect in shear to permit a controlled amount of lateral motion between opposite ends of the bolster mount, which motion is accompanied by a slight extension or contraction of the mount. The rubber pads are sufficiently stiff in the vertical plane to prevent undesirable tilting of the truck frame.

In the middle of each floating bolster 34, there is a circular plate 51 adapted to receive one of a pair of large diameter bearing pins or bosses on the underside of the locomotive car body near opposite ends of the platform 11. The static weight of the locomotive car body is transmitted via such pins to the centers of the respective bolsters on the truck assemblies. This cooperating bearing pin and center plate arrangement permits each truck assembly to swivel with respect to the locomotive car body as the wheels 36 negotiate a curved section of track.

Figure 5:
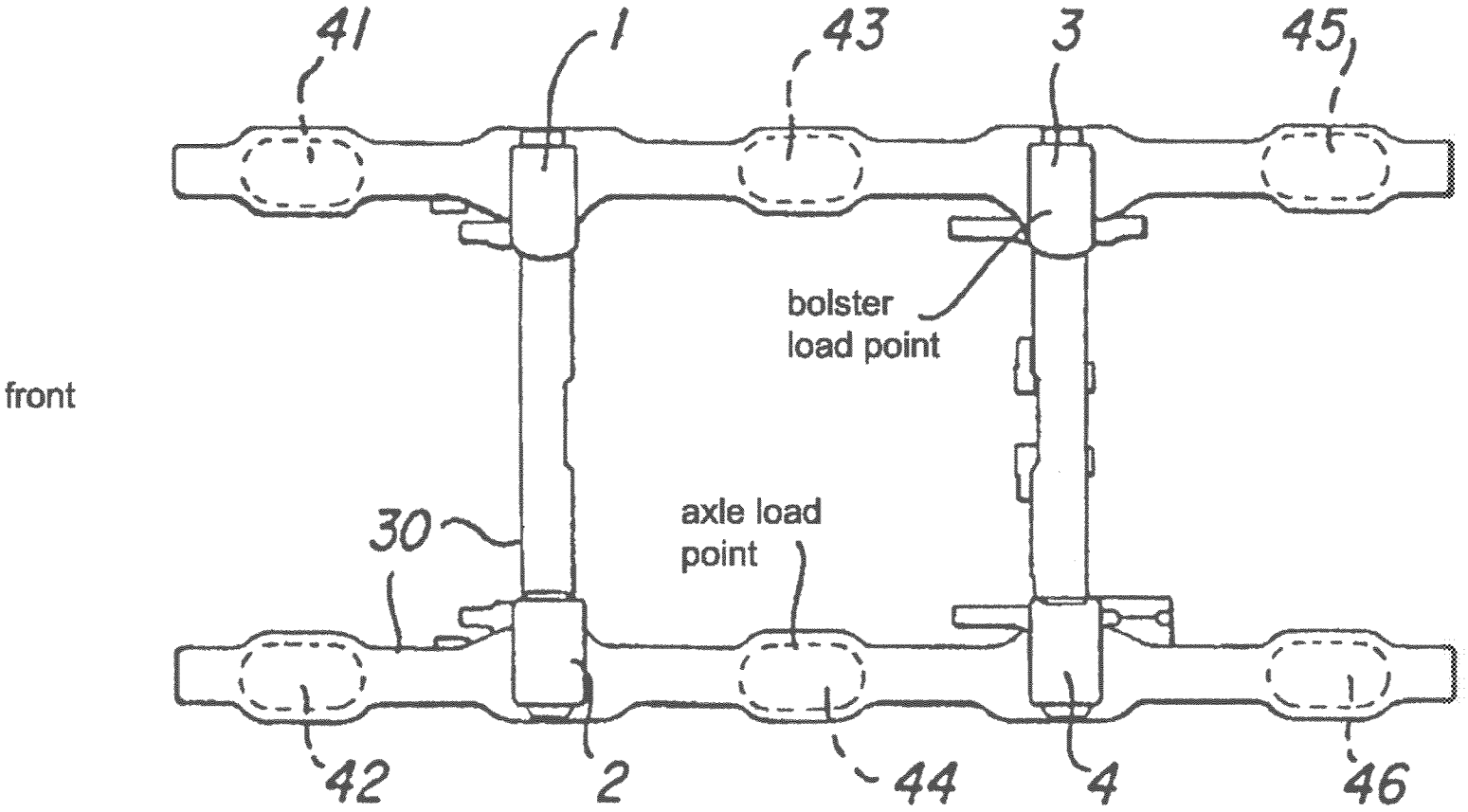
Figure 5 (Prior Art)
FIG. 5 shows a simplified plan view of a prior art 3 axle truck frame.

FIG. 5 shows a simplified plan view of a prior art 3 axle truck frame taken from U.S. Pat. No. 4,793,047 entitled "Method of Adjusting the Distribution of Locomotive Axle Loads". As is shown in FIG. 5 (the description of which is taken from that of FIG. 3 of U.S. Pat. No. 4,793,047), reference numbers 1 through 4 identify the top surfaces or bolster load points of the respective bolster mounts 50, and reference numbers 41 through 46 identify the positions of the respective axle spring pockets in the two side channels of the frame. The four bolster mounts are centered between the front and rear axles of the truck assembly. Bolster load points 1 and 2 and axle spring pockets 41 and 42 (for axle-wheel set 31) are located in the front half of the truck assembly, whereas bolster load points 3 and 4 and axle spring pockets 45 and 46 (for axle-wheel set 33) are similarly located in the rear half. This 3-axle truck assembly is asymmetrical, with the centerline of its middle axle-wheel set 32 being disposed slightly (approximately two inches) in front of the center of the truck assembly to provide extra space for the two traction motors that are located in the one gap between middle and rear axles. Consequently, the middle pair of axle spring pockets 43 and 44 in the truck frame are slightly off center. If equal loads are desired on the three axles of the assembly, the front and rear pairs of bolster load points must be unequally loaded, with more weight on points 1 and 2 than on points 3 and 4.

Figure 6:
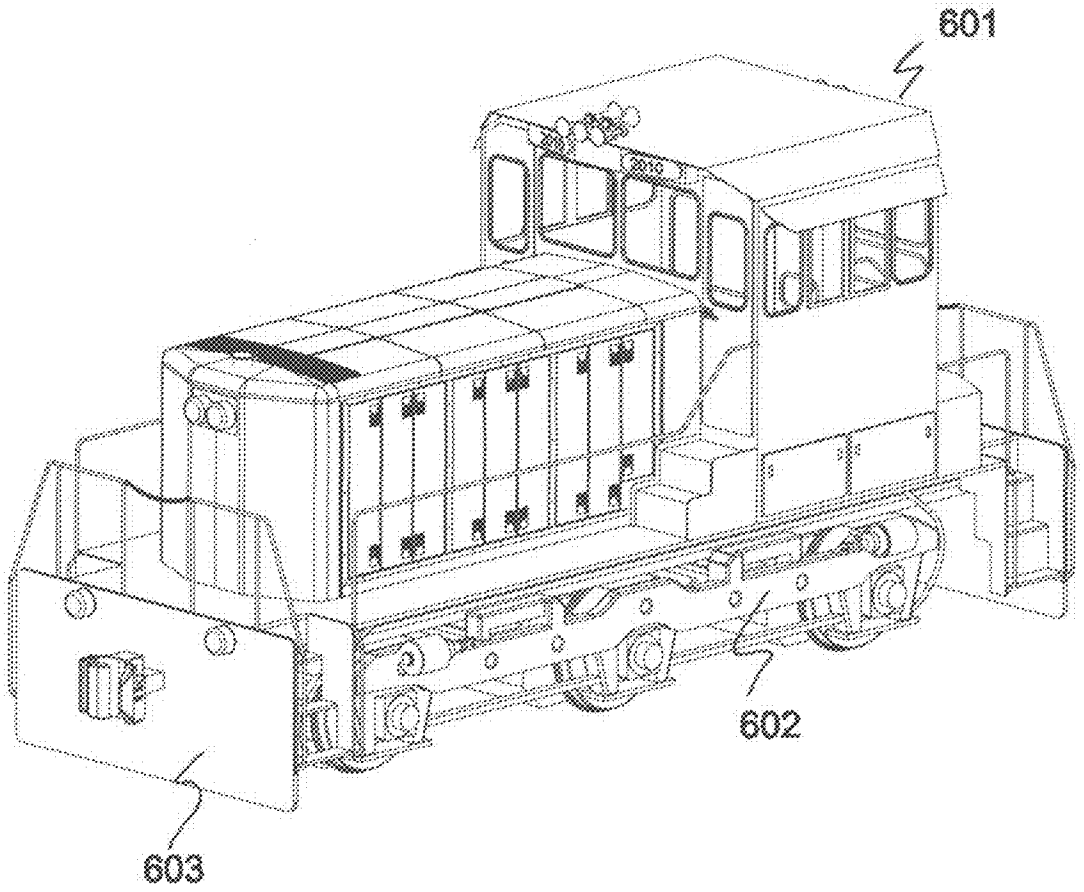
Figure 6 (Prior Art)
FIG. 6 shows a prior art industrial locomotive such as disclosed in U.S. Pat. No. 8,561,545.

FIG. 6 shows an isometric view of a prior art locomotive such as disclosed in U.S. Pat. No. 8,561,545. A locomotive car body with integral frame, cab and hood 601 is shown attached to a 3-axle truck assembly 602. Also shown is front pilot plate 603. There is also typically a rear pilot plate (partially visible at the rear).

Figure 9A:
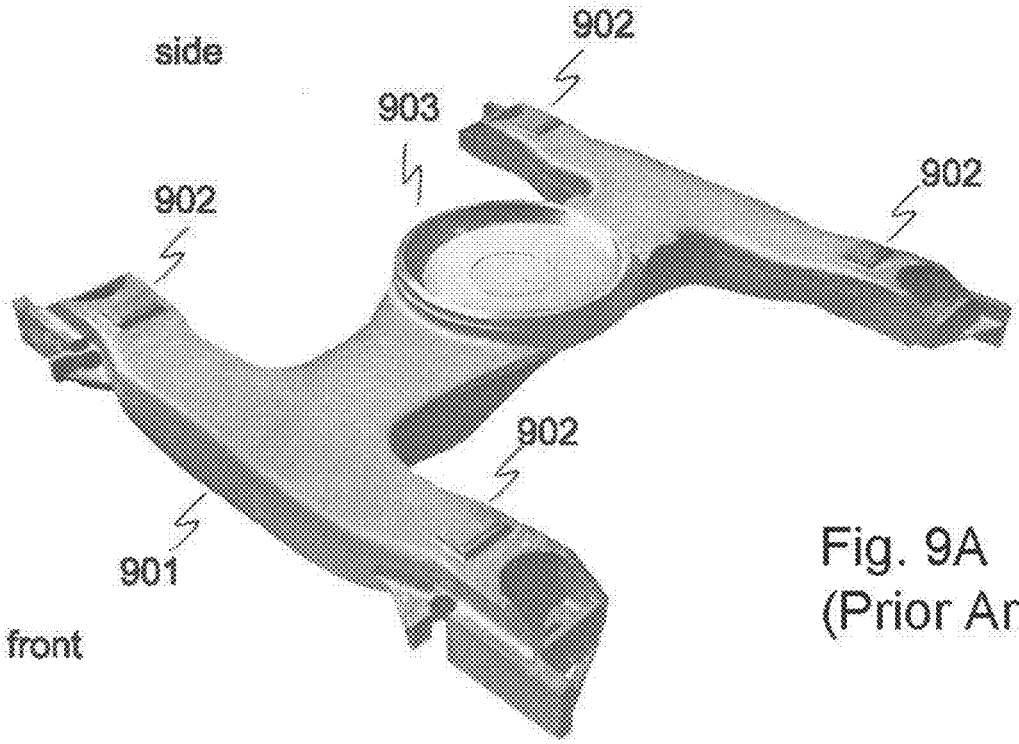
Fig. 9A (Prior Art)
FIG. 9A shows a prior art bolster bearing plate arrangement such as used in the construction of the locomotive of FIG. 6.

Although not shown in FIG. 6, the locomotive body is attached to the 3-axle truck using a modified bolster. An unmodified bolster is shown in FIG. 9A. To modify the bolster of FIG. 9A, the lip of the circular plate 903 is removed so that the underframe of the locomotive body rests on the resulting circular flat surface. This circular flat surface supports most of the weight of the locomotive body. Angle irons are then welded on the underframe of the locomotive body to constrain the longitudinal and lateral motion of the locomotive body with respect to the modified bolster. The underframe of the locomotive body also rests on the four side bearing plates 902 of FIG. 9A. This bolster configuration is welded to the locomotive body. This welded assembly then is positioned on the 3-axle truck in the same way as the arrangement described in FIG. 4. Because the modified bolster configuration is welded to the locomotive body, no rotation of the locomotive body is allowed with respect to the modified bolster. As can be appreciated, rotation for negotiating a curved section of track is not required for this single truck locomotive.

One drawback of the above modified bolster configuration is that the angle irons welded on the underframe of the locomotive body to secure the modified bolster can be bent or broken if the locomotive slams into another rail car at greater than about 5 mph. As the locomotive is used primarily for spotting operations which may involve kicking to make up or break down trains, these angle irons can become bent or broken with repeated use or when the locomotive slams into a rail car at greater than about 5 mph as a result of an inexperienced operator mistake for example.

Figure 7:
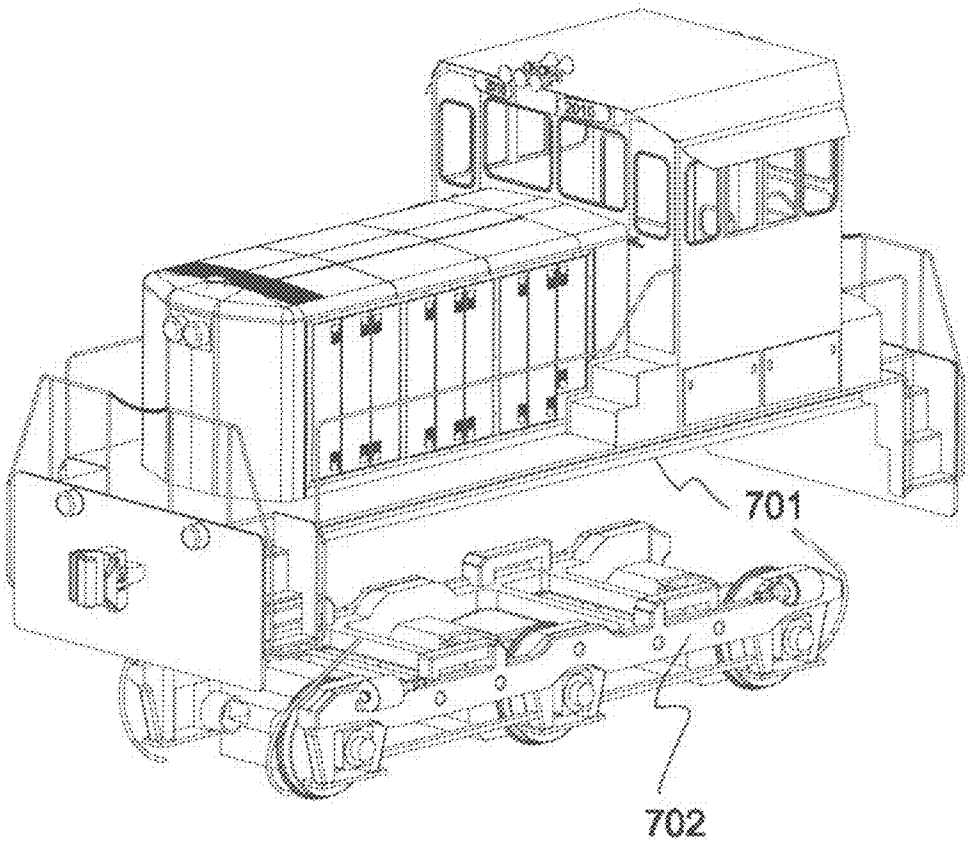
Figure 7 (Prior Art)
FIG. 7 shows an exploded view of the prior art industrial locomotive of FIG. 6.

FIG. 7 shows an exploded isometric view of the prior art locomotive of FIG. 6 also illustrating the principal elements of the present invention. This figure illustrates a locomotive car frame 701 and a 3-axle truck assembly 702 before being mated. The frame 701 can be, for example, a modified Special Duty ("SD") locomotive car frame with a "cab-end switcher" type cab. In this example, about 28 feet of the original SD donor locomotive can be used. This includes stairs, couplers, draft gears, and miscellaneous other parts to form the new locomotive body.

Figures 8A, 8B:
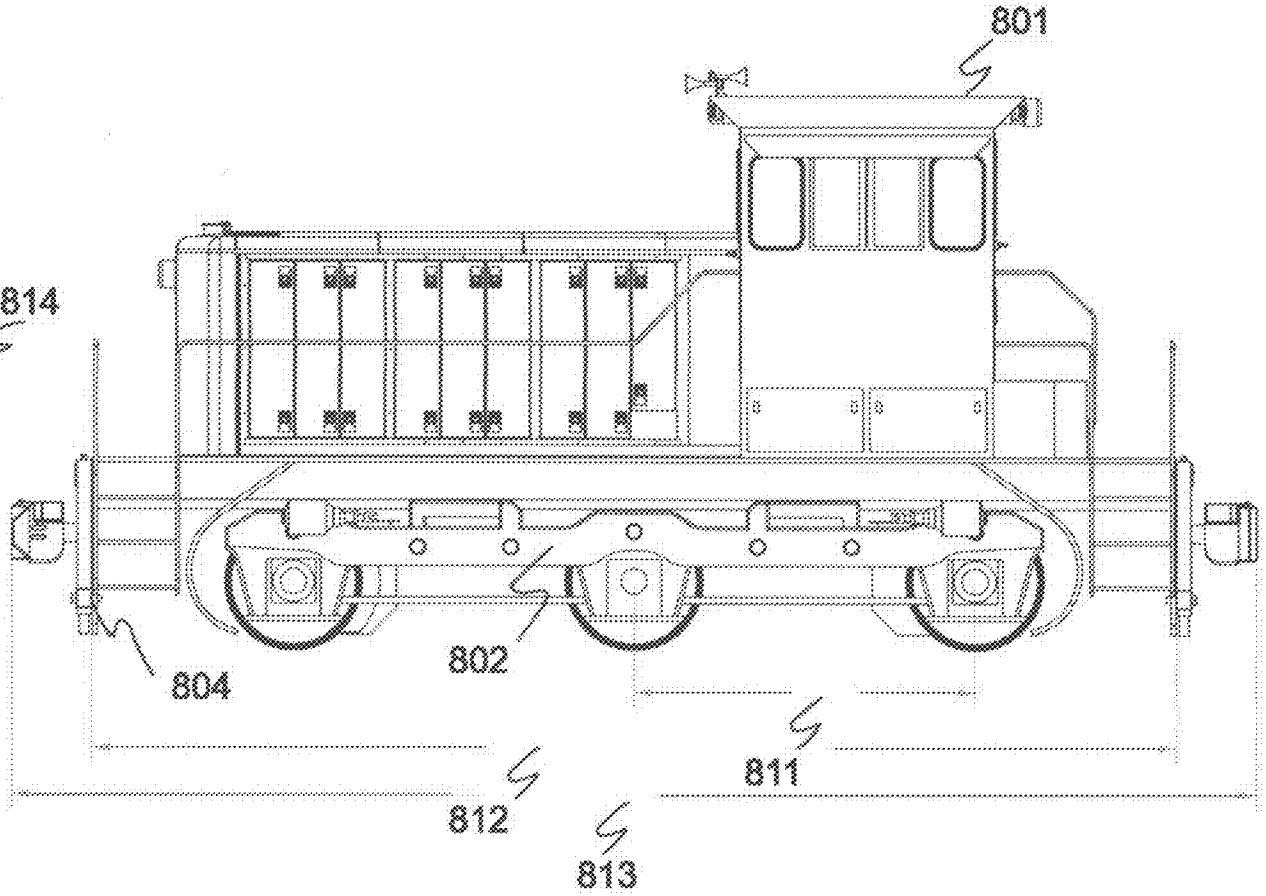
Fig. 8A (Prior Art)
Fig. 8B (Prior Art)
FIG. 8A shows a schematic side view with the principal dimensions of the prior art industrial locomotive of FIG. 6.
FIG. 8B shows a schematic front view with the principal dimensions of the prior art industrial locomotive of FIG. 6.

FIGS. 8A and 8B show a schematic front and side view with the principal dimensions of the prior art industrial locomotive of FIG. 6. FIG. 8A is a side view showing a locomotive car frame 801, a truck assembly 802 and hydraulic cylinders 804 mounted on the front and rear pilot plates. The overall length 813 of this example locomotive (coupler to coupler) is about 32 feet. The length 812 from front to rear jacking cylinders is about 28 feet. The typical center to center separation 811 of wheels on the truck assembly is about 8.5 feet. FIG. 8B is a front view of the locomotive. The height 814 of the locomotive measured from the rails is about 14 feet. The width of the locomotive 815 as determined by the front pilot plate 803 is about 10 feet. The width of the locomotive 816 including the hydraulic jacking cylinders is about 11.5 feet in this example.

Figure 9B:
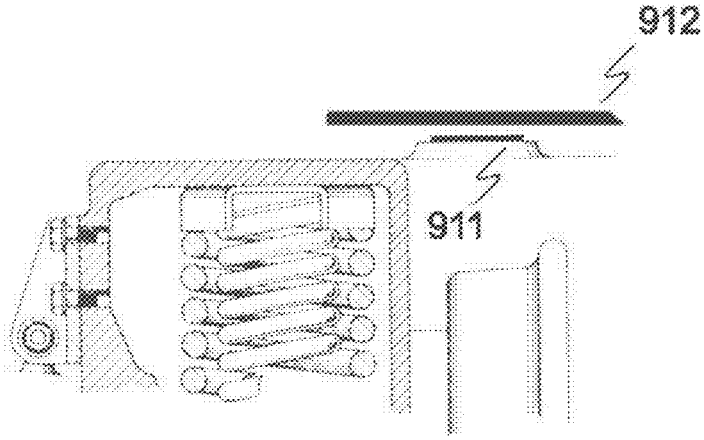
Fig. 9B (Prior Art)
FIG. 9B shows a prior art bolster bearing plate arrangement such as used in the construction of the locomotive of FIG. 6.

FIGS. 9A and 9B show a prior art bolster bearing plate arrangement such as used in the construction of the locomotive of FIG. 3. FIG. 9A shows a truck bolster frame 901 with four side bearing plates 902. FIG. 9B shows a detail of a truck side bearing plate 911 and the position of a matching locomotive body frame bearing plate 912.

As described in FIG. 6, the prior art locomotive body of U.S. Pat. No. 8,561,545 is attached to a 3-axle truck using a modified version of the bolster of FIGS. 9A and 9B. The lip of the circular plate 903 is removed so that the underframe of the locomotive body rests on the resulting circular flat surface. This circular flat surface supports most of the weight of the locomotive body. Angle irons are then welded on the underframe of the locomotive body to constrain the longitudinal and lateral motion of the locomotive body with respect to the modified bolster. The underframe of the locomotive body also rests on the four side bearing plates 902 of FIG. 9A. This bolster configuration attaches the locomotive body to the 3-axle truck in the same way as the arrangement described in FIG. 4 except no rotation of the locomotive body is allowed with respect to the modified bolster. As can be appreciated, rotation is not required for this single truck locomotive.

For the locomotive of FIG. 6, welding of the modified bolster to the locomotive body is accomplished using the truck's frame along with its spaced side bearing plates. Matching side bearing plates are attached to the frame of locomotive body. In addition, matching end bearing plates may optionally be added to both the truck assembly and the frame of the locomotive body.

Figure 10:
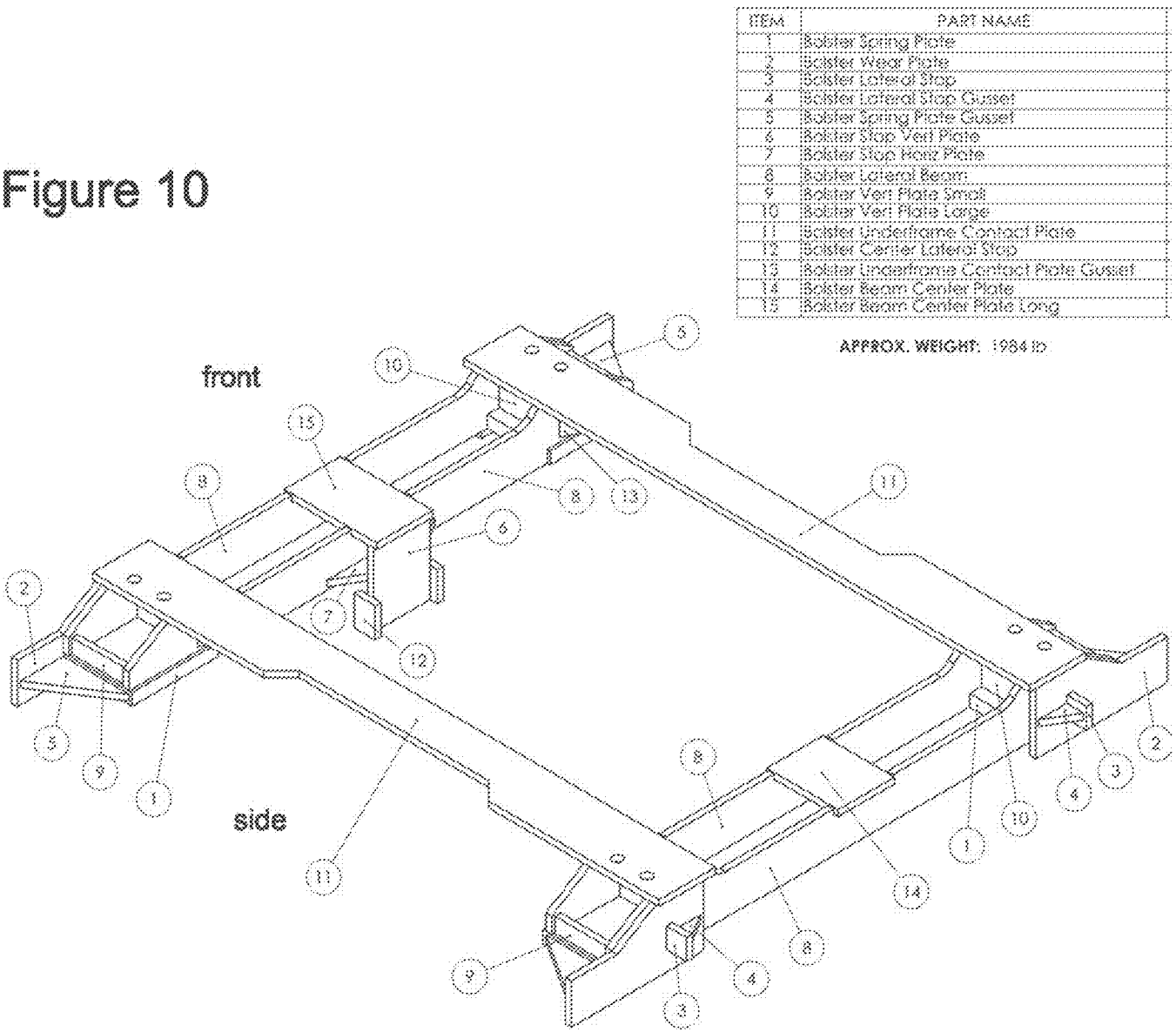
FIG. 10 shows a steel bolster frame that is part of the present disclosure used to modify the small industrial locomotive of FIG. 6.

FIG. 10 shows a steel bolster frame that is part of the present invention used to modify the small industrial locomotive of FIG. 6. As the locomotive is used primarily for spotting operations which may involve kicking for example to make up or break down trains, it is subject to large transient forces especially if the locomotive slams into another rail car at greater than about 10 mph.

The primary advantage of the bolster configuration of FIG. 10 compared to that described for the prior art locomotive of FIG. 6 is that the locomotive body can be welded onto the two long bolster underframe contact plates with long continuous welds. On impact with other rail cars, these welds are subject to primarily shear loads which are a strength advantage of welded joints. Thus both the length and orientation of the weldments are a substantial improvement over the design of attachment of the locomotive body to the modified bolster described in FIG. 6.

The bolster configuration of FIG. 10 sits on the 3-axle truck frame in exactly the same way as the bolster plate of FIG. 4 and FIGS. 9A and 9B sits on the 3-axle truck frame.

Another advantage of the bolster configuration of FIG. 10 compared to that described in FIG. 6 is that there is much more latitude, during assembly, for moving the locomotive body longitudinally and laterally on the bolster underframe contact plates in order to achieve balanced loads on the truck axles, as described below.

The following steps are representative of a procedure used to balance and weigh the industrial locomotive of FIGS. 6, 7, 8A, and 8B. This procedure is assumed to take place with a truck assembly on rail tracks typically, but not always, within or near a rail workshop.

1. hydraulic jacks are positioned under two locations, equidistant from the center, on each of the first and third axle of the truck assembly.
2. the truck assembly is then raised off the rails using the hydraulic jacks
3. the truck assembly may be weighed by recording the hydraulic pressures from the gages on the four jacks by converting to mass by the known lifting area of the jacks
4. the bolster frame is then lowered onto the truck assembly and positioned on the four rubber bolster mounts of the truck assembly
5. the truck assembly plus bolster frame is weighed by recording the hydraulic pressures from the gages on the four jacks converted to mass by the known lifting area of the jacks
6. the locomotive body with engine and other equipment installed is loaded with the supplies normally used in operation. For instance, the fuel tank is filled with diesel fuel oil, water is supplied to the cooling water tank, pipes and heat exchangers, lubricating oil is supplied to the engine lube oil system, and a locomotive battery is put in the battery box.
7. the loaded locomotive body is then lowered onto the bolster frame and positioned at the approximate location estimated to achieve balance. Balance herein means achieving equal hydraulic pressure at all four jack locations within a predetermined specification.
8. the locomotive body is then moved slowly both longitudinally and laterally by lifting or jacking on the bolster frame until balance is achieved (i.e. with equal hydraulic pressure on all four jacks within a predetermined specification)

9. the balance position of the locomotive body on the bolster frame is then marked
10. the truck assembly plus bolster frame plus loaded locomotive body is weighed by recording the hydraulic pressures from the gages on the four jacks and converting to mass by the known lifting area of the jacks
11. the loaded locomotive body and bolster frame are then removed
12. the supplies normally used in operation are removed from the locomotive body
13. the bolster frame is then welded onto the locomotive body using the markings made at balance position on the bolster frame
14. the empty locomotive body and bolster frame are then lowered back onto the truck assembly with the bolster frame positioned on the four rubber bolster mounts of the truck assembly
15. the truck assembly plus bolster frame plus empty locomotive body is weighed by recording the hydraulic pressures from the gages on the four jacks converted to mass by the known lifting area of the jacks
16. The assembled locomotive is then lowered back onto the rails and the hydraulic jacks are removed
17. The fabrication of the locomotive is then completed
18. The balance of the locomotive may be checked by repeating steps 7 through 10

As can be appreciated the truck assembly may be lowered back onto the tracks at any time during the above procedures and then raised back up off the tracks to resume the procedures.

Figure 11A:
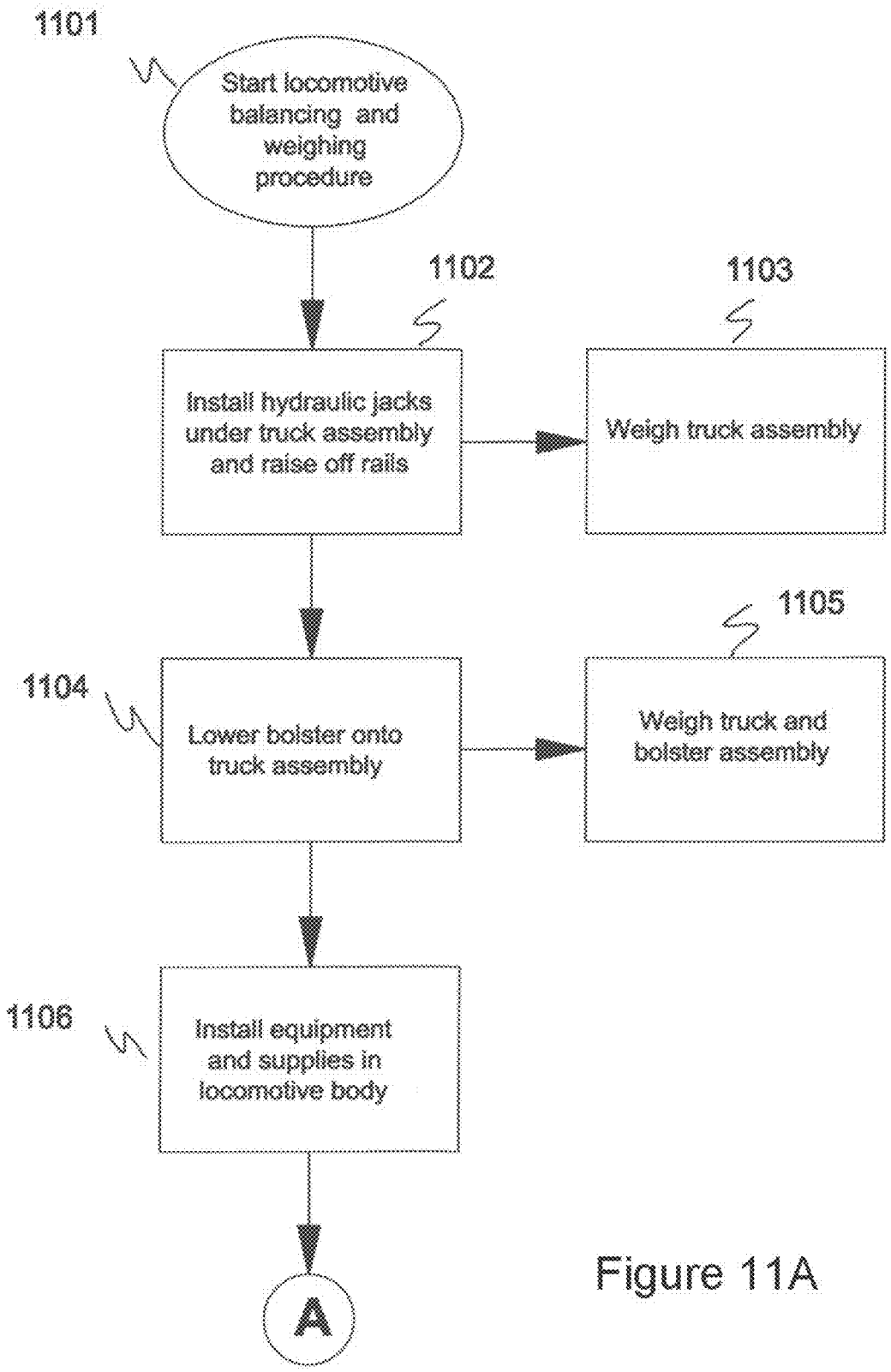
FIG. 11A is part of a flow chart of the balancing and weighing procedure for a small industrial locomotive.

FIGS. 11A-11D are a flow chart of the balancing and weighing procedure for a small industrial locomotive. In FIG. 11A, the balancing and weighing procedure begins 1101 by installing four hydraulic jacks to raise the 3-axle truck assembly off the rails 1102. Jacks are located under the first and third axles with a jack located near the wheel on each side of both axles. The jacks have pressure gages which indicate the load supported by each jack when the pressure is converted to mass by the known lifting area of the jacks. Once the truck is raised, the weight of the truck can be determined 1103. This step may be omitted if the weight of the truck is already known within a predetermined accuracy.

In step 1104, the bolster assembly is lowered onto the truck assembly onto its proper location on the four rubber bolster mounts of the truck assembly. The weight of the truck and bolster can be determined 1105. This step may be omitted if the weight of the truck and bolster are already known within a predetermined accuracy.

In step 1106, the engine and other equipment is installed in the locomotive body and the locomotive body is loaded with the supplies normally used in operation. For instance, the fuel tank is filled with diesel fuel oil, water is supplied to the cooling water tank, pipes and heat exchangers, lubricating oil is supplied to the engine lube oil system, and a locomotive battery is put in the battery box.

Figure 11B:
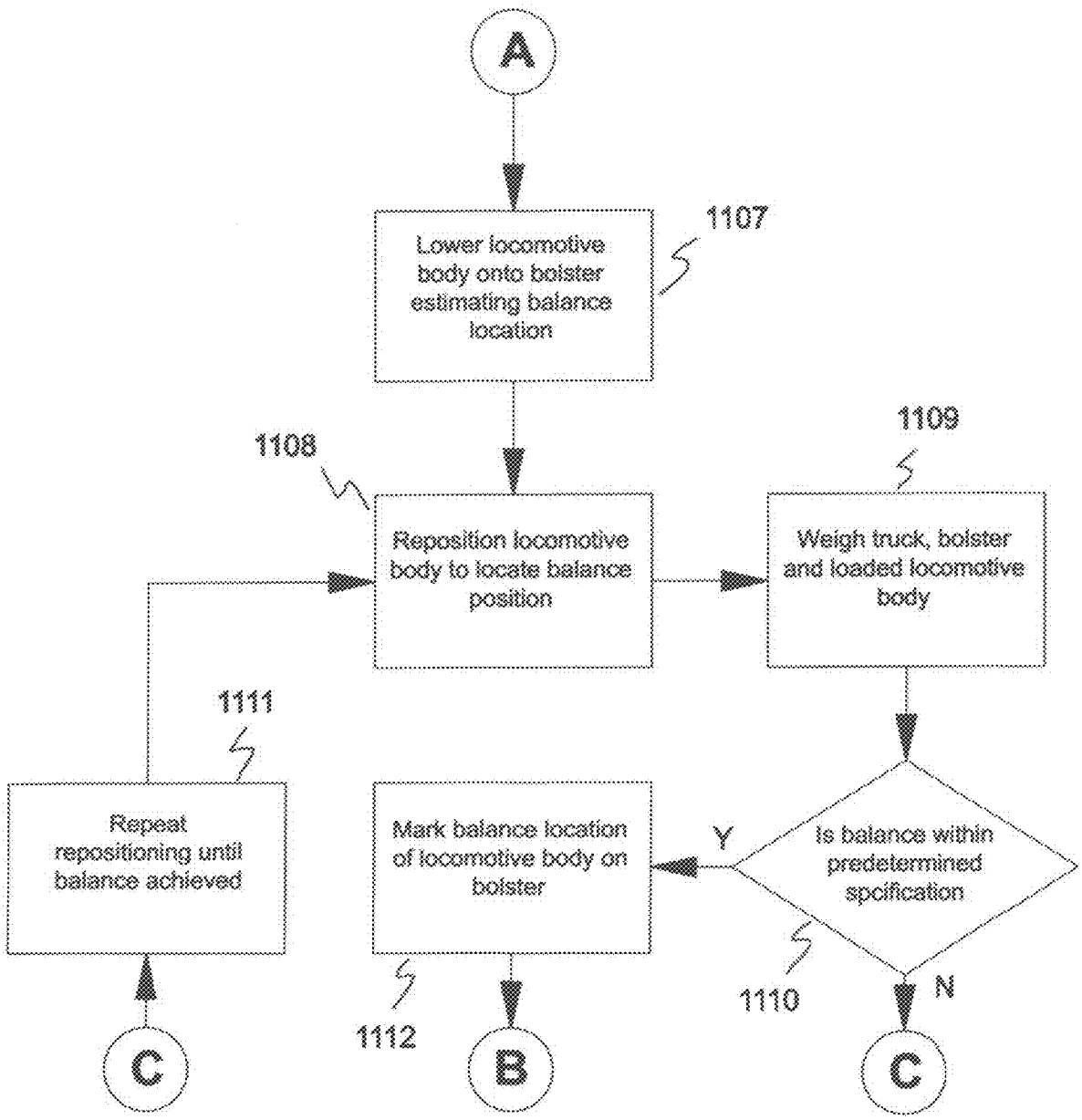
FIG. 11B is part of the flow chart in FIG. 11A for the balancing and weighing procedure for a small industrial locomotive.

The procedure is continued in FIG. 11B with the loaded locomotive body being lowered 1107 onto the bolster at approximately the locations where balance is expected to be achieved.

In step 1108 the locomotive body is moved laterally and longitudinally along the two long bolster underframe contact plates until balance is achieved. Balance is achieved when the load on each of the four jacks are equal to within a predetermined specification. The weight of the truck, bolster and loaded locomotive body can then be determined 1109. In step 1110, if proper balance is achieved, then the procedure moves to step 1112 wherein the positions of the locomotive body are marked on the two long bolster underframe contact plates.

In step 1110, if proper balance is not achieved, then the procedure returns to 1111 where step 1108 is repeated until balance is achieved.

Figure 11C:
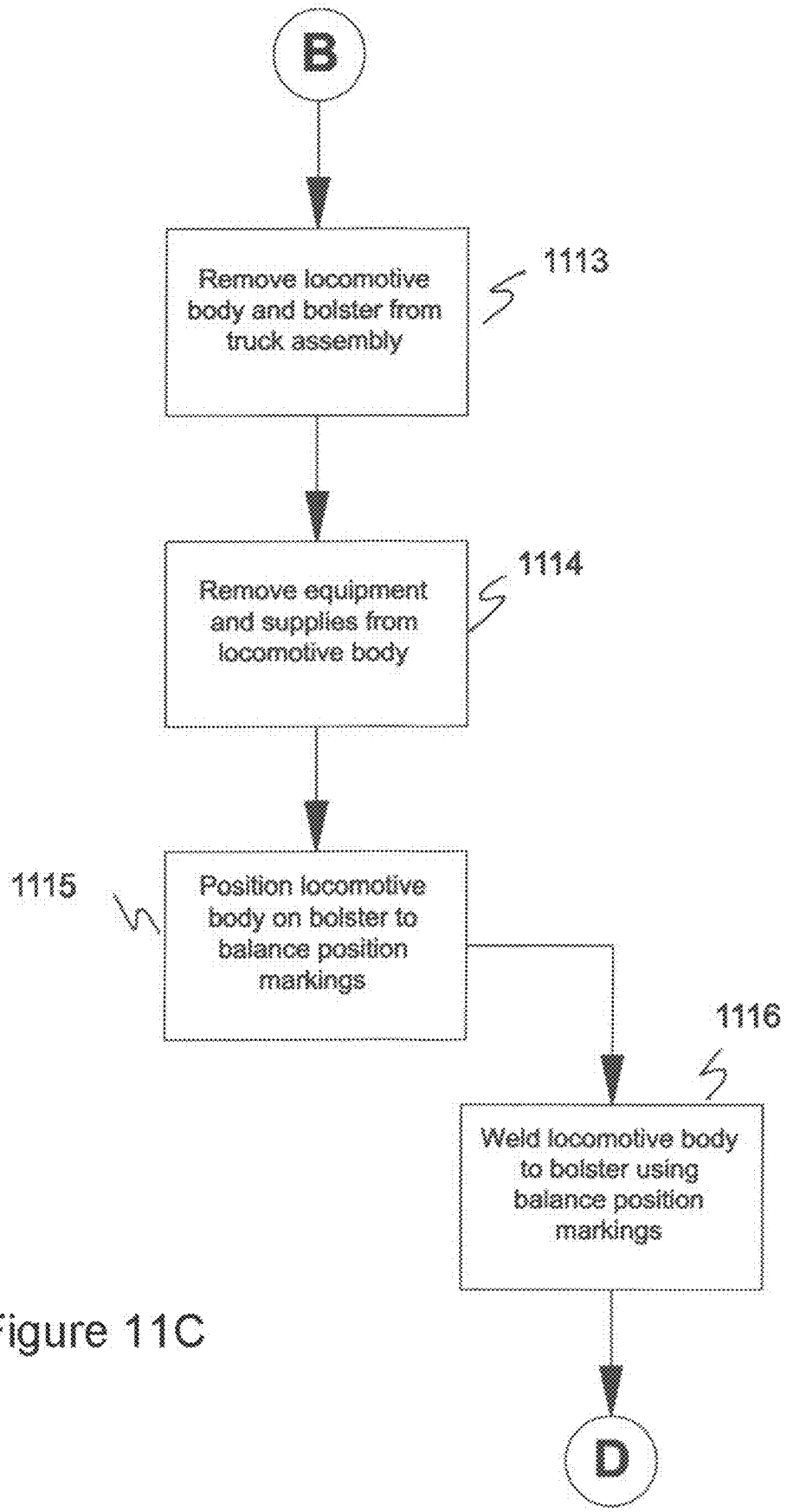
FIG. 11C is part of the flow chart in FIG. 11B for the balancing and weighing procedure for a small industrial locomotive.

In FIG. 11C, the balance and weighing procedure is continued with step 1113 wherein the loaded locomotive body and bolster are removed from the truck assembly and, in step 1114, the supplies normally used in operation are removed from the locomotive body and the engine may also be removed.

In step 1115, the empty locomotive body is then positioned and secured on the bolster assembly using the markings made in step 1112. The locomotive body is then welded 1116 to the two long bolster underframe contact plates to form a rigid unit.

Figure 11D:
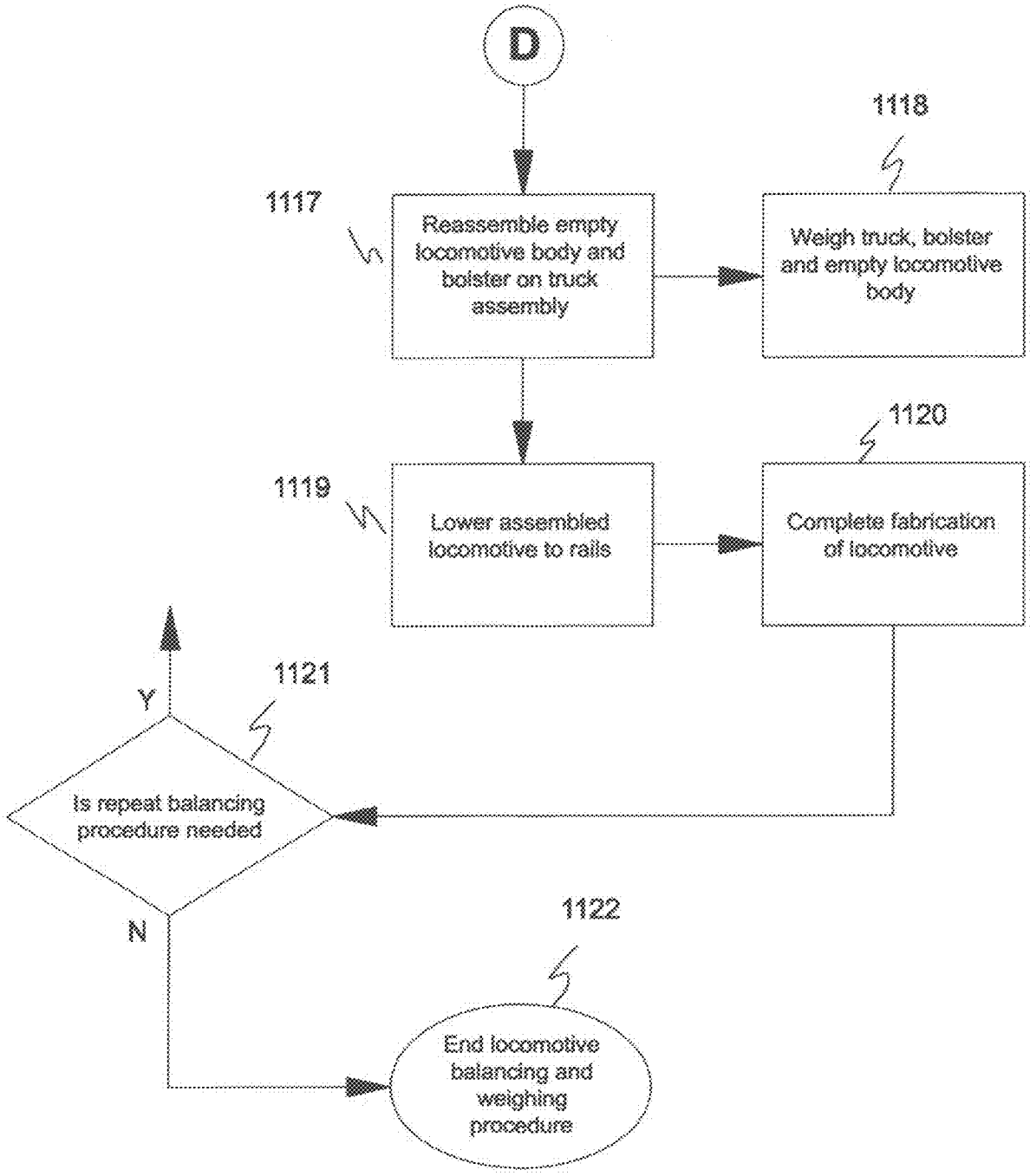
FIG. 11D is part of the flow chart in FIG. 11C for the balancing and weighing procedure for a small industrial locomotive.

As shown in FIG. 11D, the empty locomotive body with bolster attached is then lowered back onto the truck assembly 1117 at which time this configuration may be weighed 1118.

The locomotive assembly (locomotive body, bolster and truck) is lowered back onto the rails 1119. The fabrication and outfitting of the locomotive is then completed 1120.

In step 1121, a decision is made whether to check the balance of the loaded locomotive. If it is decided that this is not necessary, the balance and weighing procedure is terminated 1122. If it is decided to recheck the balance, then the locomotive can be reloaded with the supplies normally used in operation and the balance procedure can be repeated. Since the locomotive body is already welded to the bolster, any rebalancing would require appropriate weights to be added to the locomotive body until balance is achieved when the load on each of the four jacks are equal to within a predetermined specification.

The following steps are representative of an alternate, simplified procedure used to balance and weigh the industrial locomotive of FIGS. 6, 7, 8A, and 8B. This procedure is assumed to take place with a truck assembly on rail tracks typically, but not always, inside a rail workshop.

1. the bolster frame is set on the truck assembly and positioned on the four rubber bolster mounts of the truck assembly
2. the empty locomotive body is then lowered onto the bolster frame and positioned at the approximate location estimated to achieve balance
3. a single hydraulic jack is positioned under the journal housing of a first wheel of the front axle until this wheel is lifted off the rail by approximately about 1/32 of an inch
4. the load on the axle at this wheel location is determined by recording the hydraulic pressure from the gage on the jack and converting it to mass by the known lifting area of the jack
5. the procedures of steps 3 and 4 are repeated for the first wheel of the rear axle, then the second wheel of the front axle and then the second wheel of the rear axle. As can be appreciated the order of lifting each wheel is not important and any order of applying the hydraulic jack to lift a wheel is permitted.
6. the locomotive body is then lifted or jacked slowly both longitudinally and laterally on the bolster frame and the procedures of steps 3, 4, 5 and 6 are repeated until balance is achieved. Balance herein means achieving equal hydraulic pressure at all four jack locations within a predetermined specification.

7. the balance position of the locomotive body on the bolster frame is then marked
8. the truck assembly plus bolster frame plus locomotive body may be weighed by recording the hydraulic pressures from the gages on the four jack locations converting to mass by the known lifting area of the jack
9. the locomotive is then lowered back onto the rails and the hydraulic jack is removed
10. the locomotive body and bolster frame are then removed from the truck assembly
11. the bolster frame is then welded onto the locomotive body using the markings made at balance position on the bolster frame
12. the fabrication of the locomotive is then completed
13. the balance of the locomotive may be checked by repeating steps 3 through 7

Figure 12A:
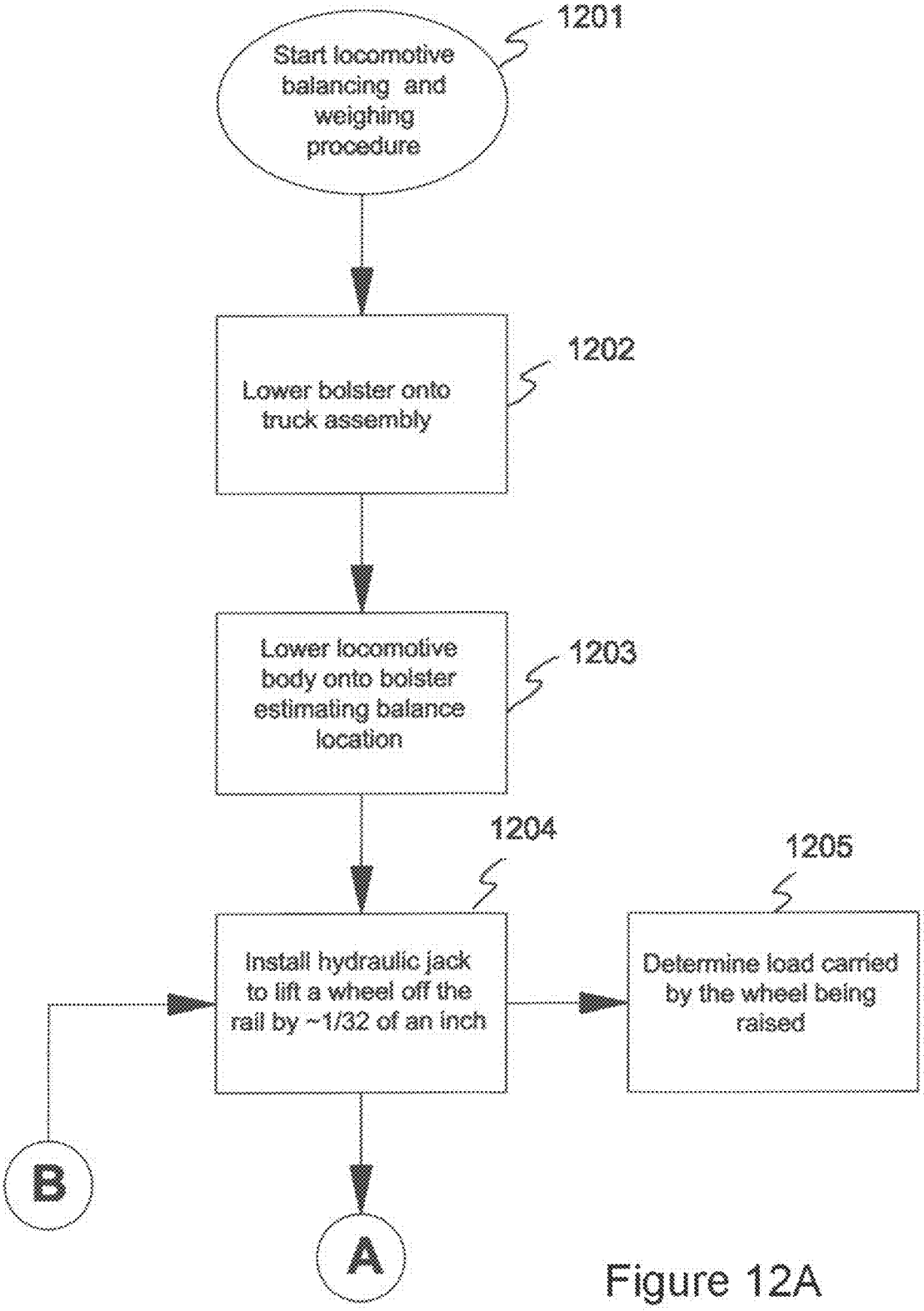
FIG. 12A is part of a flow chart of an alternate method balancing and weighing procedure for a small industrial locomotive.

As can be appreciated the truck assembly may be lowered back onto the tracks at any time during the above procedures and then raised back up off the tracks to resume the procedures FIGS. 12A-12D are a flow chart of an alternate method balancing and weighing procedure for a small industrial locomotive. In FIG. 12A, the balancing and weighing procedure begins 1201 by lowering the bolster assembly onto the truck assembly 1202 onto its proper location on the four rubber bolster mounts of the truck assembly. The empty locomotive body is lowered 1203 onto the bolster at approximately the locations where balance is expected to be achieved.

In step 1204, a single hydraulic jack is positioned under the journal housing of a first wheel of the front axle until this wheel is lifted off the rail by approximately about 1/32 of an inch. In step 1205, the load on the axle at this wheel location is determined by recording the hydraulic pressure from the gage on the jack and converting it to mass by the known lifting area of the jack.

Figure 12B:
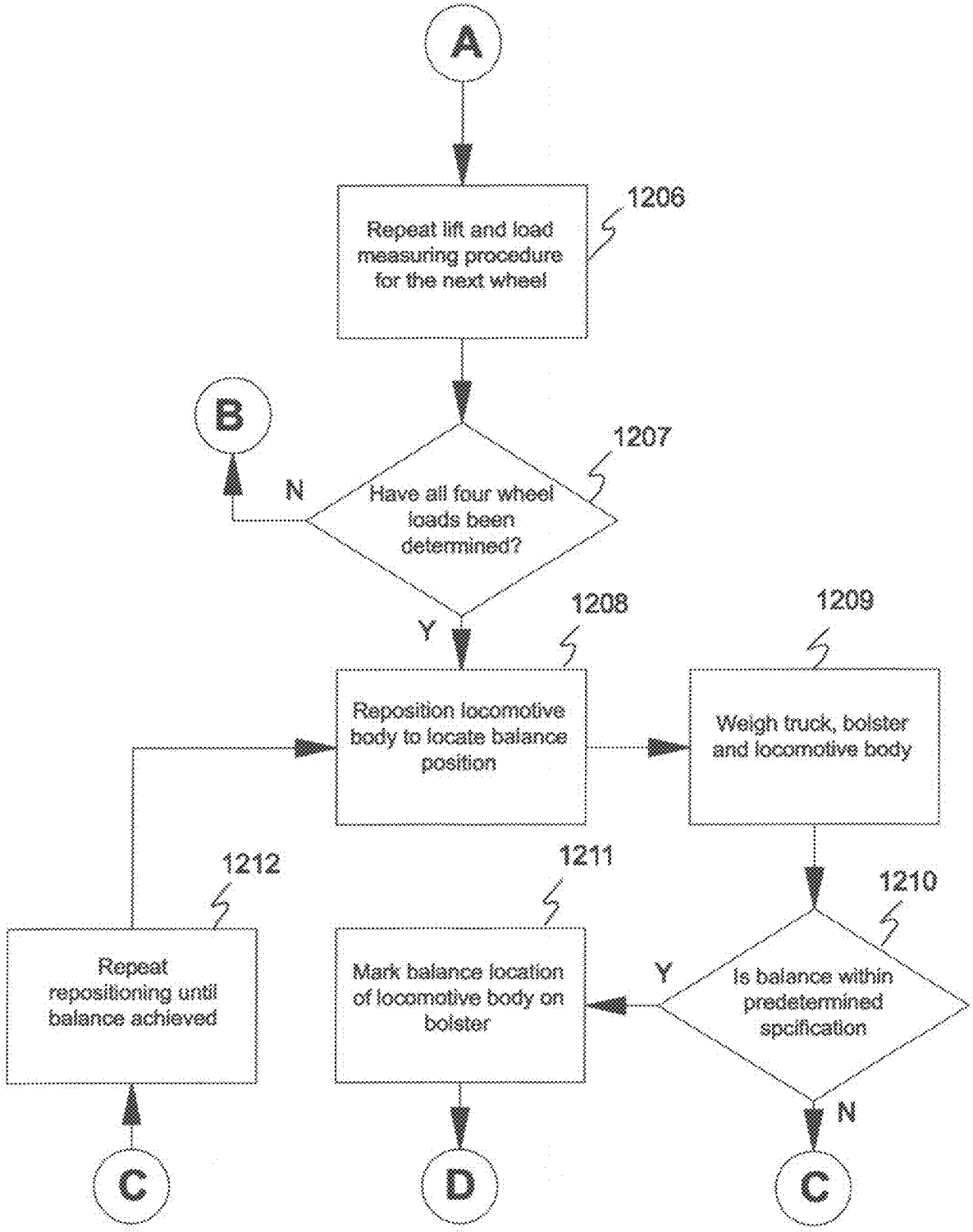
FIG. 12B is part of the flow chart in FIG. 12A for an alternate method balancing and weighing procedure for a small industrial locomotive.

As shown in FIG. 12B, the procedures of steps 1204 and 1205 are repeated 1206 for the other three wheels of the truck assembly in any order. When the loads on all four wheels have been determined 1207, the locomotive body is moved (by lifting or jacking) laterally and longitudinally along the two long bolster underframe contact plates 1208 and the load on each axle is determined until balance is achieved. The sum of the loads on the four axles is equal to the weight of the empty locomotive assembly 1209. Balance is achieved when the load on each of the four wheels is equal to within a predetermined specification. In step 1210, if proper balance is achieved, then the procedure moves to step 1211 wherein the positions of the locomotive body are marked on the two long bolster underframe contact plates.

Figure 12C:
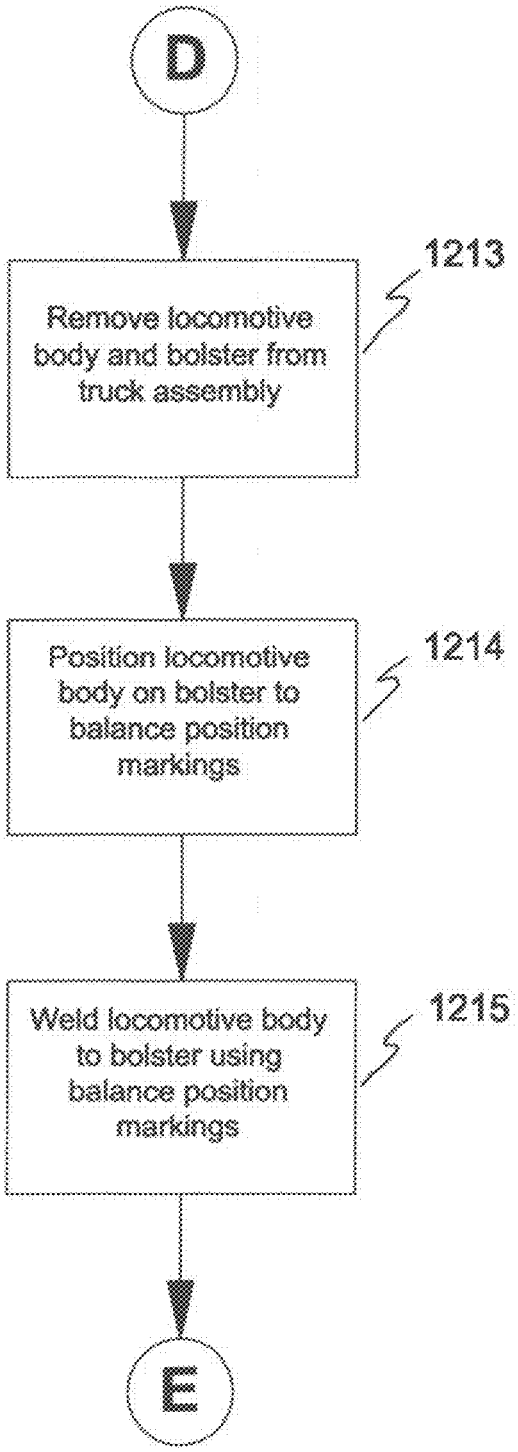
FIG. 12C is part of the flow chart in FIG. 12B for an alternate method balancing and weighing procedure for a small industrial locomotive.

In FIG. 12C, the balance and weighing procedure is continued with step 1213 wherein the locomotive body and bolster are removed from the truck assembly and, in step 1214, the empty locomotive body is then positioned and secured on the bolster assembly 1214 using the markings made in step 1212. The locomotive body is then welded 1215 to the two long bolster underframe contact plates to form a rigid unit.

Figure 12D:
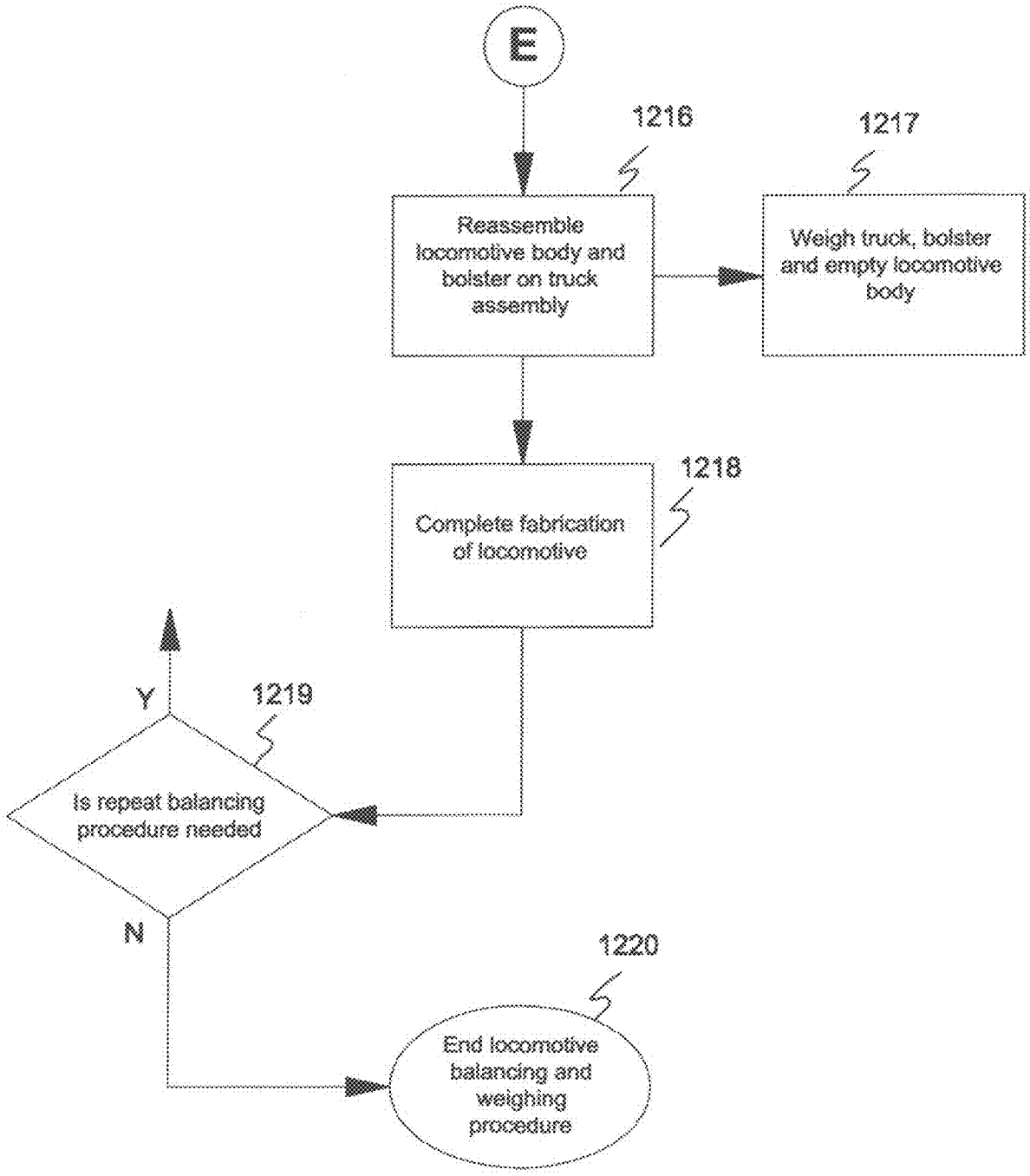
FIG. 12D is part of the flow chart in FIG. 12C for an alternate method balancing and weighing procedure for a small industrial locomotive.

As shown in FIG. 12D, the empty locomotive body with the bolster now welded onto it, is then lowered back onto the truck assembly 1216 at which time this configuration may be weighed 1217 again. This step may be omitted or used to check the result of step 1209.

The fabrication and outfitting of the locomotive is then completed 1218. In step 1219, a decision is made whether to check the balance of the loaded locomotive. If it is decided that this is not necessary, the balance and weighing procedure is terminated 1220. If it is decided to recheck the balance, then the balance procedure can be repeated. Since the locomotive body is already welded to the bolster, any rebalancing would require appropriate weights to be added to the locomotive body until balance is achieved when the load on each of the four jacks are equal to within a predetermined specification.

A number of variations and modifications of the disclosures can be used. As will be appreciated, it would be possible to provide for some features of the disclosures without providing others.

For example, the apparatus and procedures described in this disclosure can be applied to a locomotive utilizing a two axle truck assembly.

The present disclosure, in various embodiments, includes components, methods, processes, systems and/or apparatus substantially as depicted and described herein, including various embodiments, sub-combinations, and subsets thereof. Those of skill in the art will understand how to make and use the present disclosure after understanding the present disclosure. The present disclosure, in various embodiments, includes providing devices and processes in the absence of items not depicted and/or described herein or in various embodiments hereof, including in the absence of such items as may have been used in previous devices or processes, for example for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover though the description of the disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A bolster system for a locomotive, comprising:

a truck configured to travel along a rail, the truck having an axle with a rotation axis and the truck having at least one suspension device with a suspension axis, wherein the suspension axis is substantially perpendicular to the rotation axis;

a bolster interconnected to the at least one suspension device such that the bolster moves relative to the truck along the suspension axis;

a first underframe plate and a second underframe plate of the bolster, wherein the underframe plates define an upper surface of the bolster; and a locomotive body interconnected to the bolster, wherein a first weld seam interconnects the locomotive body to the first underframe plate, and a second weld seam interconnects the locomotive body to the second underframe plate such that the locomotive body is interconnected and fixed relative to the bolster, and wherein the weld seams are oriented substantially perpendicular to the rotation axis of the axle of the truck and substantially perpendicular to the suspension axis of the at least one suspension device.

2. The bolster system of claim 1, wherein the first underframe plate has a longitudinal dimension that is substantially perpendicular to the rotation axis of the axle of the truck and substantially perpendicular to the suspension axis of the at least one suspension device.

3. The bolster system of claim 2, wherein the first welded seam has a longitudinal dimension which is at least 60% as long as the longitudinal dimension of the first underframe plate.

4. The bolster system of claim 1, wherein the at least one suspension device is a coil spring.

5. The bolster system of claim 1, wherein the truck comprises three axles.

6. The bolster system of claim 1, wherein the weld seams are continuous along a longitudinal dimension.

7. A method for positioning a locomotive on a bolster, comprising:

providing a truck having an axle with a rotation axis and having at least one suspension device with a suspension axis, wherein the suspension axis is substantially perpendicular to the rotation axis;

positioning a bolster on the at least one suspension device of the truck such that the bolster moves relative to the truck along the suspension axis;

positioning a locomotive body on the bolster;

determining, by at least one scale, a weight measurement underneath four points of the truck;

repositioning the locomotive body on the bolster such that the at least one scale determines a weight measurement within a predetermined range; and welding a first seam and a second seam between the locomotive body and the bolster, wherein the seams are oriented substantially perpendicular to the rotation axis of the axle of the truck and to the suspension axis of the at least one suspension device.

8. The method of claim 7, further comprising:

providing a first underframe plate and a second underframe plate of the bolster, wherein the underframe plates define an upper surface of the bolster, the locomotive is positioned on the underframe plates, and the seams are located on the underframe plates.

9. The method of claim 7, wherein the at least one scale is a hydraulic jack with a pressure gauge.

10. The method of claim 7, wherein the four points are equidistant from a center point of the truck.

11. The method of claim 7, wherein the locomotive body is repositioned such that the at least one scale determines substantially the same weight measurement.

12. The method of claim 7, wherein the seams have a longitudinal dimension which is at least 60% as long as a longitudinal dimension of the bolster.

13. The method of claim 7, wherein the seams have a continuous longitudinal dimension.

14. The method of claim 7, further comprising:

filling the locomotive with a predetermined amount of fuel prior to the determining step.

15. A method for positioning a locomotive on a bolster, comprising:

providing a truck having an axle with a rotation axis and having at least one suspension device with a suspension axis, wherein the suspension axis is substantially perpendicular to the rotation axis;

positioning a bolster on the at least one suspension device of the truck such that the bolster moves relative to the truck along the suspension axis;

positioning a locomotive body on the bolster;

providing a scale underneath a first point of the truck, wherein the scale is configured to determine a weight measurement;

determining, by the scale, a first weight measurement underneath the first point of the truck;

repositioning the scale underneath a second point, a third point, and a fourth point of the truck to determine a second weight measurement, a third measurement, and a fourth measurement, respectively;

repositioning the locomotive body on the bolster such that the weight measurements are within a predetermined range; and welding a first seam and a second seam between the locomotive body and the bolster, wherein the seams are oriented substantially perpendicular to the rotation axis of the axle of the truck and substantially perpendicular to the suspension axis of the at least one suspension device.

16. The method of claim 15, wherein the locomotive body is repositioned such that each scale determines substantially the same weight measurement.

17. The method of claim 15, further comprising:

providing a first underframe plate and a second underframe plate of the bolster, wherein the underframe plates define an upper surface of the bolster, the locomotive is positioned on the underframe plates, and the seams are welded to the underframe plates.

18. The method of claim 15, wherein the four scales are hydraulic jacks with pressure gauges.

19. The method of claim 18, wherein determining each weight measurement comprises raising the truck by approximately 1/32 inch.

20. The method of claim 15, wherein the seams have a longitudinal dimension which is at least 60% as long as a longitudinal dimension of the bolster.

21. The bolster system of claim 1, further comprising:

at least one scale configured to determine a weight measurement underneath four points of the truck to confirm that the weight measurement is within a predetermined range.

* * * * *